US007135630B2

(12) United States Patent
Maruhashi et al.

(10) Patent No.: US 7,135,630 B2
(45) Date of Patent: Nov. 14, 2006

(54) DURABLE PERCUSSION PAD EFFECTIVE AGAINST NOISE, SILENT PERCUSSION INSTRUMENT, SILENT PERCUSSION INSTRUMENT SET AND ELECTRONIC PERCUSSION SYSTEM

(75) Inventors: Masahiko Maruhashi, Shizuoka (JP); Takashi Sando, Shizuoka (JP); Motoya Kondoh, Shizuoka (JP)

(73) Assignee: Yamaha Corporation, Shizuoka-Ken (JP)

( * ) Notice: Subject to any disclaimer, the term of this patent is extended or adjusted under 35 U.S.C. 154(b) by 62 days.

(21) Appl. No.: 10/602,681

(22) Filed: Jun. 25, 2003

(65) Prior Publication Data

US 2004/0149120 A1 Aug. 5, 2004

(30) Foreign Application Priority Data

Jan. 31, 2003 (JP) ..... 2003-025306
Apr. 18, 2003 (JP) ..... 2003-114344

(51) Int. Cl.
*G10D 13/02* (2006.01)

(52) U.S. Cl. ..... 84/411 P; 84/411 R

(58) Field of Classification Search ..... 84/411 P, 84/411 M, 414, 411 R
See application file for complete search history.

(56) References Cited

U.S. PATENT DOCUMENTS 4,479,412 A * 10/1984 Klynas ..... 84/730
4,589,323 A * 5/1986 Belli et al. ..... 84/411 R
4,852,443 A * 8/1989 Duncan et al. ..... 84/733
5,056,403 A 10/1991 Yamashita
6,525,249 B1 * 2/2003 Suenaga ..... 84/411 R
6,586,666 B1 * 7/2003 Abe ..... 84/477 R
2002/0112593 A1 * 8/2002 Yanase ..... 84/411 P

FOREIGN PATENT DOCUMENTS

DE 100 56 540 A1 8/2001
FR 2 682 799 4/1993
FR 2 814 272 3/2002

* cited by examiner

*Primary Examiner*—Kimberly Lockett
(74) *Attorney, Agent, or Firm*—Dickstein Shapiro LLP

(57) ABSTRACT

A drum head is broken down into a head body, which in turn is broken down into a solid portion and an accumulating portion, and a rigid base plate; the solid portion offers a beaten surface to a drummer, and the accumulating portion or an array of pillars and the base plate form in combination a locally vibratory portion; when a drummer strikes the beaten surface with a stick, the solid portion caves in for accumulating a part of the impact load, and gives rise to resilient deformation of the pillars beneath the cave so that another part of the impact load is accumulated in the deformed pillars as the elastic strain energy; the elastic strain energy is released through the local vibrations of the pillars, and the vibration energy is transmitted to a small amount of the air therearound so that the noise is faint.

40 Claims, 15 Drawing Sheets

DURABLE PERCUSSION PAD EFFECTIVE AGAINST NOISE, SILENT PERCUSSION INSTRUMENT, SILENT PERCUSSION INSTRUMENT SET AND ELECTRONIC PERCUSSION SYSTEM

FIELD OF THE INVENTION

This invention relates to a percussion instrument and, more particularly, to a percussion pad, a percussion instrument equipped therewith, a set of percussion instruments and an electronic percussion system using the percussion instrument.

DESCRIPTION OF THE RELATED ART

Drums are typical examples of the percussion instrument. The drums are broken down into two categories. Although the drums of both categories have respective drum heads to be beaten by drummers, the beats are produced through different processes. The drum head serves as a percussion pad in the drum, and terms "drum pad" and "skin" are synonyms of the drum head. The drums in the first category are hereinafter referred to as "acoustic drums", and the drum sound is generated through the vibrations of the drum head. On the other hand, the drums of the other category are referred to as "electronic drums", and the drum sound is generated through an electronic data processing repeatedly initiated at the beats on the drum head. The drum sound produced through the vibrations of the drum head is referred to as "acoustic drum sound" or "acoustic beats", and the electronically produced drum sound is referred to as "electronic drum sound" or "electronic beats".

The acoustic drums are popular to music lovers, and many youths are challenging the acoustic drums. The drum heads are, by way of example, made from sheets of synthetic resin such as polyester, and are stretched over hollow spaces defined by shells. Drummers beat the drum heads with sticks, and the shells make the acoustic drum sound loud. In fact, the acoustic drum sound is so loud that most of the youths worry about the training place. Because, the neighborhood grumble at the loud drum sound. A mute is required for the acoustic drum. Otherwise, the trainees are to practice the stick work on a training pad instead of the acoustic drum. A mute cover is a typical example of the mute for the acoustic drums. The mute cover is laminated on the drum head, and the trainee beats the mute cover with the sticks. The mute cover absorbs the impacts at the beats, and prevents the drum head from the vibrations. For this reason, the trainee can practice the stick work under reduction in loudness. The training pad is a specially designed drum head, and is less vibratory. The trainee changes the drum head from the ordinary one to the training pad before the practice, and beats the training pad with the sticks. Nevertheless, the mute cover and training pad make the drum sound thick. The trainee feels the acoustic drum sound curious. Another drawback is weak restitution at the beats on the pad. The trainee feels the restitution soft as if he or she beats a cushion. Yet another drawback inherent in the mute for the acoustic drums is that the loudness is uncontrollable. Even if the trainee practices the stick work in an environment where the acoustic drum sound less disturbs the neighborhood, the mute cover and training pad reduces the loudness as if he or she is practicing the stick work in an apartment house.

The electronic drums are free from the drawbacks inherent in the acoustic drums. This is because of the fact that the electronic drum sound is generated through the electronic data processing. A vibration sensor or a pick-up is incorporated in the electronic drum, and the vibration sensor detects the vibrations of the drum head. The vibration sensor supplies an electric signal representative of the vibrations, and the electronic data processing is initiated with the electric signal. An audio signal is produced through the electronic data processing, and is converted to the electronic drum sound through a sound system. The sound system includes a power amplifier, and the drummer can vary the loudness by manipulating the volume switch. Thus, the user can easily vary the loudness, and the electronic drum is preferable to the trainees from the viewpoint of the volume control.

A drawback inherent in the electronic drum is noise, which is generated at the beats on the drum pad. The noise is offensive to the ear. Especially, when the user turns down the volume, the noise strikes the user's ear. Thus, the noise is the serious drawback in the electronic drums.

Two approaches have been proposed against the noise. The first approach is to damp the vibrations of the drum head rapidly. A damping layer adhered to the reverse surface of the drum head is a result of the first approach. The damping layer has a large damping factor, and makes the drum head come to rest rapidly. This results in fairly soft noise.

Another approach is to reduce the vibration energy propagated from the drum head to the air. A result of the second approach has been sold in the market as a "mesh". The mesh is a drum head made from a lamination of nets with large meshes. The ordinary drum head is made from a sheet of synthetic resin, and the vibrations are propagated from the entire surface to the air. On the other hand, the mesh is porous, and the air passes through a lot of holes among the threads. For this reason, while the mesh is vibrating, the vibration energy is transmitted from the surfaces of the threads to the air. Only part of vibration energy is transmitted to the air so that the noise is soft.

The second approach further results in a drum head disclosed in Japan Patent Application laid-open No. 2001-142459. The prior art drum head is a compromise between the ordinary drum head and the mesh. The prior art drum head is made from a punched sheet, i.e., a sheet of synthetic resin formed with plural holes, and the diameter of the holes ranges from sub-millimeter to several millimeters. The holes permit the air to pass therethrough so that the vibration energy is partially transmitted from the drum head to the air. A damping layer is provided beneath the porous drum head, and makes the vibrations rapidly come to rest.

Those prior art drum heads are fairly effective against the loud noise, and are available for both acoustic training and electronic drums with or without vibration sensors. However, the following problems are encountered in those prior art drum heads.

The problem inherent in the drum head adhered with the damping layer is poor muting characteristics. Although the prior art drum head with the damping layer is fairly effective against the noise, the noise is louder than the noise head from the mesh. The noise is still offensive to the user's ear. Most of the vibration energy is consumed through the internal friction of the damping layer during the vibrations. However, a time period required for the drain on the energy is not short enough to make the noise faint. Another problem is the weak restitution at the beats on the drum head. The weak restitution is derived from the damping layer. When a drummer strikes the drum head adhered with the damping layer with a stick, the drum head and damping layer resiliently cave in around the area struck with the stick, and vibrate together. The damping layer softly receives the stick, and makes the restitution weaker than that of the ordinary drum head, i.e., the drum head without any damping layer. The drummer feels the sticks heavier than those on the ordinary drum head.

The mesh also makes the drummer feel the sticks different from those on the ordinary drum head. The drummer feels the sticks lighter than those on the ordinary drum head. This is because of the fact that the mesh imparts strong restitution to the sticks. As described hereinbefore, only small part of the vibration energy is transmitted from the mesh to the air, and the remaining vibration energy causes the mesh to vibrate continuously. Moreover, the mesh is small in mass. For this reason, the strong restitution is exerted on the stick, and the drummer feels the sticks lighter than those on the ordinary drum head. Another problem inherent in the mesh is frictional sound due to the vibrating threads. Even though the mesh is effective against the loud drum sound, the fairly reduced noise is superimposed with the frictional sound, and the total amount of noise is not so small as expected. Yet another problem inherent in the mesh is a great production cost. In other words, the mesh is expensive. The plural sheets of nets constitute the mesh. The nets are laminated on one another such that the strings of one net cross the strings of another net at a predetermined angle. A large amount of time and labor is consumed, and makes the production cost great. Still another problem inherent in the mesh is local dependency influential in producing the electric signal in the vibration sensor. A drummer is assumed to strike the mesh with a stick. The stick depresses the threads, and stretches them. Then, the stretched threads further depress the other threads, and the influence is spread over the mesh. The area at which the drummer strikes with the stick is widely depressed, and the depth is maximum. However, the depression shallows inversely proportional to the distance from the area. If the area is close to the vibration sensor, the vibration sensor produces a high peak in the electric signal. On the other hand, if the area is far from the vibration sensor, the vibration sensor produces a low peak. This means that the first peak representative of the strike is less discriminative from the other peaks of the vibrations. For this reason, the controller is liable to miss the shots.

A problem inherent in the porous drum head is fairly good in both muting characteristics and the feeling at the beats. However, there is a trade off between the durability and the muting characteristics. The plural holes are effective against the noise. However, they make the porous drum head breakable. On the other hand, if the holes are reduced in size or number, the noise becomes offensive to the ear.

SUMMARY OF THE INVENTION

It is therefore an important object of the present invention to provide a percussion pad, which exhibits good muting characteristics without sacrifice of the durability.

It is another important object of the present invention to provide a silent percussion instrument, which includes the percussion pad.

It is yet another important object of the present invention to provide a silent percussion instrument set, in which the silent percussion instrument is incorporated.

It is still another important object of the present invention to provide an electronic percussion system, which is fabricated on the basis of the silent percussion instrument.

To accomplish the object, the present invention proposes to release accumulated impact load through local vibrations.

In accordance with one aspect of the present invention, there is provided a percussion pad comprising a surface to be beaten by a player, an accumulator made of resilient material, connected in series to the surface so as to be locally deformed at each beat by the player for accumulating an elastic strain energy and locally vibratory while the elastic strain energy is being released, and a base made of a material smaller in resiliency than the accumulator, provided on the opposite side of the accumulator from the surface and held in contact with the accumulator for permitting the accumulator to be locally deformed.

In accordance with another aspect of the present invention, there is provided a silent percussion instrument comprising a percussion pad including a surface to be beaten by a player, an accumulator made of resilient material, connected in series to the surface so as to be locally deformed at each beat by the player for accumulating an elastic strain energy and locally vibratory while the elastic strain energy is being released and a base made of a material smaller in resiliency than the accumulator, provided on the opposite side of the accumulator from the surface and held in contact with the accumulator for permitting the accumulator to be locally deformed, a supporting structure for keeping the percussion pad in an attitude convenient to be beaten by the player and a coupling device connected between the percussion pad and the supporting structure for preventing the percussion pad from separation from the supporting structure. In accordance with yet another aspect of the present invention, there is provided a silent percussion instrument set comprising plural silent percussion instruments, and at least one of the plural silent percussion instruments includes a percussion pad having a surface to be beaten by a player, an accumulator made of resilient material, connected in series to the surface so as to be locally deformed at each beat by the player for accumulating an elastic strain energy and locally vibratory while the elastic strain energy is being released and a base made of a material smaller in resiliency than the accumulator, provided on the opposite side of the accumulator from the surface and held in contact with the accumulator for permitting the accumulator to be locally deformed, a supporting structure for keeping the percussion pad in an attitude convenient to be beaten by the player and a coupling device connected between the percussion pad and the supporting structure for preventing the percussion pad from separation from the supporting structure.

In accordance with still another aspect of the present invention, there is provided an electronic percussion system comprising a silent percussion instrument including a percussion pad including a surface to be beaten by a player, an accumulator made of resilient material, connected in series to the surface so as to be locally deformed at each beat by the player for accumulating an elastic strain energy and locally vibratory while the elastic strain energy is being released and a base made of a material smaller in resiliency than the accumulator, provided on the opposite side of the accumulator from the surface and held in contact with the accumulator for permitting the accumulator to be locally deformed and a supporting structure for keeping the percussion pad in an attitude convenient to be beaten by the player and a coupling device connected between the percussion pad and the supporting structure for preventing the percussion pad from separation from the supporting structure, at least one vibration sensor monitoring the percussion pad to see whether or not the player beats the surface and producing an electric signal when the player gives each beat to the surface, and an electronic percussion sound generator connected to the at least one vibratory sensor, carrying out a data processing on pieces of data information on the electric signal for producing an audio signal and converting the audio signal to an electronic percussion sound.

BRIEF DESCRIPTION OF THE DRAWINGS

The features and advantages of the percussion pad, silent percussion instrument, silent percussion instrument set and electronic percussion system will be more clearly understood from the following description taken in conjunction with the accompanying drawings, in which FIG. 19 is a perspective view showing pillars of another head body.

DESCRIPTION OF THE PREFERRED EMBODIMENTS

Drum Head and Drum

Figure 1:
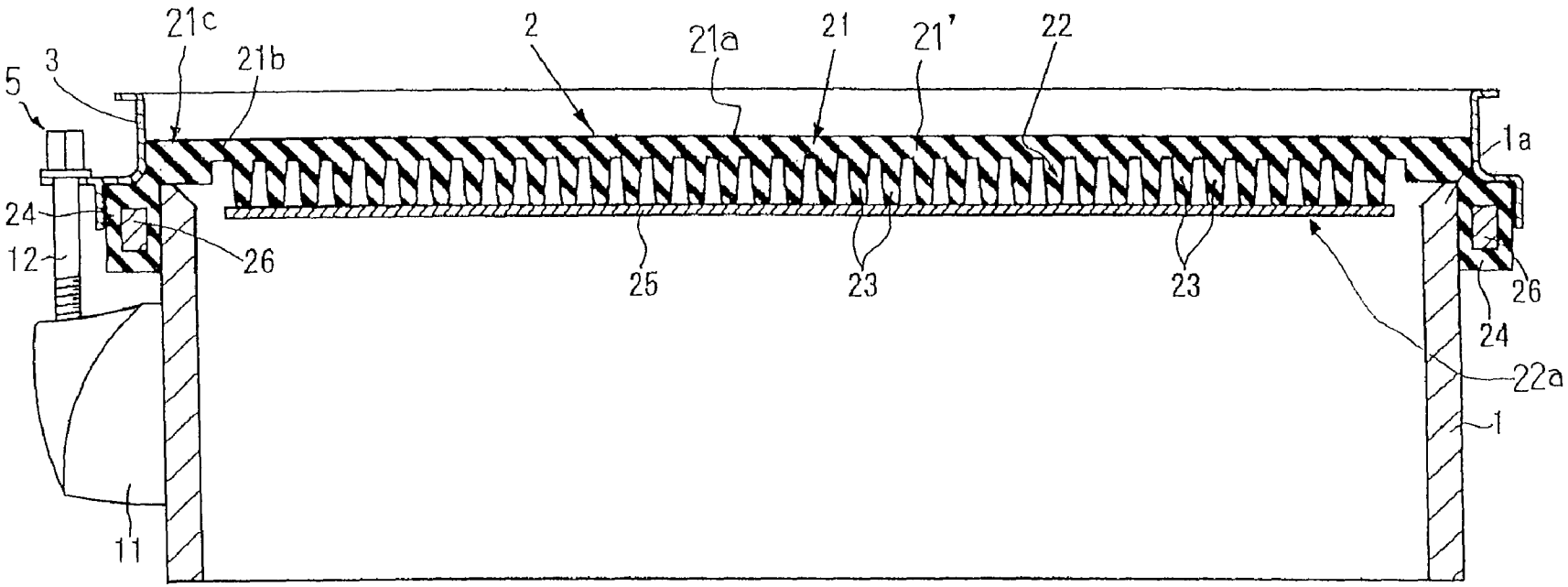
FIG. 1 is a cross sectional view showing the structure of a drum according to the present invention.

A drum head according to the present invention is broken down into a solid portion and a locally vibratory portion. The solid portion offers a surface to be beaten to a drummer, and is made of material which exhibits a large damping factor. The solid portion is durable so that the drum head has the lifetime much longer than that of the prior art porous drum head. The locally vibratory portion is connected in series to the solid portion, and has an energy accumulating sub-portion. The energy accumulating sub-portion is made of material which has a capability to accumulate a large amount of elastic strain energy. If certain material satisfies those requirements for the solid portion and energy accumulating sub-portion, the solid portion and energy accumulating sub-portion are made of the certain material. In case where the solid portion and accumulating sub-portion have a monolithic structure, the monolithic structure is, by way of example, shaped through a molding process, and the production cost is drastically reduced. However, the designer wishes to optimize the material. If so, the solid portion and accumulating sub-portion are separately produced, and, thereafter, the solid portion is assembled with the locally vibratory portion.

A drummer is assumed to strike the surface of the solid portion with sticks. The solid portion caves in, and gives rise to resilient deformation in the locally vibratory portion. The solid portion vibrates, and part of the impact load is converted to heat through the internal friction. Other part of the impact load is accumulated in the accumulating sub-portion in the form of elastic strain energy. The elastic strain energy causes a part of the locally vibratory portion beneath the spot beaten with the stick to vibrate. However, the locally vibratory portion keeps the remaining part static. The vibrating part merely drives a small amount of the air to vibrate, and, accordingly, an extremely small amount of energy is transmitted from the vibrating part to the air. This results in a faint noise. The elastic strain energy is released through the local vibrations. Thus, the impact energy is rapidly consumed without any loud voice.

Another drum head includes a rigid portion and a resilient portion as well as the solid portion and locally vibratory portion. The resilient portion is made of material, which has the modulus of elasticity optimized for the purpose described hereinlater in detail. The solid portion offers a beaten surface to a drummer, and is connected in series to the locally vibratory portion. The rigid portion is provided around the solid portion, and the resilient portion is connected between the solid portion and the rigid portion. The rigid portion is coupled to a frame such as, for example, a shell. In this instance, the locally vibratory portion also improves the muting characteristics, and is effective against the noise.

The resilient portion permits the solid portion and locally vibratory portion to move in the up-and-down direction. The up-and-down motion is causative of the rebound of the stick on the surface of the solid portion. In other words, the modulus of elasticity and the measurements of the resilient portion are selected in such a manner that the restitution makes the drummer feel the stick as light as the stick rebounding on the ordinary drum head. Thus, the drum head is durable and effective against the noise, and makes the drummer feel the stick work as similar to that on the ordinary drum head.

Yet another drum head according to the present invention is implemented by a locally vibratory portion. When a drummer strikes the locally vibratory portion with a stick, the impact load is accumulated in the locally vibratory portion as the elastic strain energy. The elastic strain energy is released from the locally vibratory portion through vibrations of a part of the locally vibratory portion. The vibration energy is transmitted from the vibrating part to the air. However, the contact area between the vibrating part and the air is so narrow that the noise is faint.

The above-described drum heads are hereinafter described in more detail.

First Embodiment

Referring to FIG. 1 of the drawings, a drum embodying the present invention comprises a shell 1, a drum head 2, a rim 3 and a tension regulator 5. The rim 3 is sometimes called as "hoop". The drum head 2 is stretched over an opening of the shell 1, and is clamped between the shell 1 and the rim 3 by means of the tension regulator 5. The drum head 2 is of the type having a large damping factor, and, accordingly, suppresses vibrations rapidly. The drum head 2 has a continuous top surface of a non-fabric resilient member so that any friction sound is never produced in the vibrations. The drum head 2 accumulates a large amount of elastic strain energy, and exhibits a large amount of force of restitution at a beat thereon. This results in that drummers feel the sticking work close to that on the ordinary drum head.

The components 1, 2, 3 and 5 will be described in more detail. The shell 1 has a cylindrical shape, and is open at both ends thereof to the air. The drum head 2 has a disc shape, and the rim 3 has a ring shape. The drum head 2 and rim 3 are larger in diameter than the shell 1 is. One of the openings of the shell 1 is closed with the drum head 2, and the drum head 2 is crowned with the rim 3. The tension regulator 5 is secured at one end thereof to the shell 1, and the other end of the tension regulator 5 is pressed to the rim 3. Thus, the drum head 2 is pinched between the rim 3 and the shell 5.

In this instance, the tension regulator 5 includes lugs 11 and tuning bolts 12. The lugs 11 are arranged on the side surface of the shell 1 at intervals, and are secured to the shell 1. Female threads are formed in the lugs 11, respectively. The rim 3 is formed with through-holes, and the through-holes are arranged along the periphery of the rim 3 at the intervals of the lugs 11. For this reason, the through-holes are alignable with the female threads. The tuning bolts 12 pass through the through-holes, and are engaged with the female threads. A drummer drives the tuning bolts 12 into the lugs 11, and presses the drum head 2 to the shell 1 through the rim 3 so as to exert the tension to the drum head 2. The shell 1, rim 3 and tension regulator 5 are same as those of an ordinary acoustic drum, and no further description is incorporated hereinafter for the sake of simplicity.

Description is focused on the drum head 2. The drum head 2 includes a head body 21 and a base plate 25. The head body 21 has a disc shape, and offers the continuous flat surface to drummers. The head body 21 is made of resilient material such as, for example, elastomer. The elastomer is a general term representative of highly resilient polymer at room temperature, and natural rubber, synthetic rubber and low grade synthetic resin are examples of the elastomer. Thermoplastic elastomer is preferable to the head body 21. The thermoplastic elastomer behaves like the rubber. However, the thermoplastic elastomer exhibits good fluidity at high temperature. This means that the thermoplastic elastomer is shaped into the head body 21 through a molding process as similar to the synthetic resin.

Mixture of ethylene propylene rubber and other sorts of elastomer such as reinforcing fillers is desirable for the head body 21 against blooming, i.e., aged discoloration. The ethylene propylene rubber is sometimes abbreviated as EPDM. The plural sorts of elastomer are to be blended such that the head body 21, which is made of the mixture, exhibits optimum muting characteristics/restitution characteristics.

The elastomer exhibits a high elongation within the limit of elasticity. Although the elongation of metal is less than 0.2%, the elastomer has the elongation ranging from 100% to 1000%. For this reason, the elastomer can accumulate a large amount of elastic strain energy. When the force is removed from the elastomer, the atomic arrangement returns to the state in which the elastomer was before exerting the force thereon.

A large damping factor is another attractive property of the elastomer. Vibrations, especially at high-frequencies, are suppressed in the elastomer through the internal loss by virtue of the large damping factor.

The base plate 25 has a disc shape, and is smaller in diameter than the head body 21. The base plate 25 exhibits the rigidity larger than that of the head body 21. Especially, large flexural rigidity is required for the base plate 25. When a drummer strikes the head body 21, the base plate 25 keeps itself flat so as to permit the head body 21 to be resiliently deformed.

Another property required for the base plate 25 is fairly good damping characteristics for suppressing the vibrations. An iron plate such as a laminated damping steel sheet is preferable to the base plate 25. A light metal plate such as an aluminum plate, a titanium plate and a manganese plate, a stainless plate and a hard synthetic resin plate are available for the base plate 25. In case where the base plate 25 is made of hard synthetic resin, the base plate 25 is to be thick enough to withstand repetition of the stick work. The base plate 25 may be reinforced with ribs.

The head body 21 has a solid portion 21' and an accumulating portion 22. The solid portion 21' has a flat surface **21*a*, and a drummer beats the flat surface 21*a* with sticks during his or her performance. The accumulating portion 22 and base plate 25 as a whole constitute a locally vibratory portion 22*a*. In this instance, the accumulating portion 22*a* is implemented by an array of pillars 23. The pillars 23 downwardly project from the solid portion 21' so that the solid portion 21' is integral with the accumulating portion 22. The pillars 23 are constant in height over the array, and are adhered to the base plate 25. Otherwise, the pillars 23 are fusion bonded to the base plate 25. In this instance, the pillars 23 are shaped into a frustum of cone. The pillars 23 are preferable for the molding process, because the molded products are smoothly taken out from the molding dies. The pillars 23 are further preferable from the viewpoints of the durability and deformability. These advantages are common to different sorts of frustums. The pillars 23 are regularly formed under the solid portion 21'. In other words, the density of pillars 23 is constant in the array. The pillars 23** are spaced from one another at regular intervals.

In the fabrication process, the manufacturer concurrently shapes the solid portion and accumulating portion 22 through a molding process, and the molded product is adhered or fusion bonded to the base plate 25. Thus, the manufacturing process is simple, and the production cost is lowered.

The locally vibratory portion **22*a* is located on the opposite side of the solid portion 21' from the flat surface 21*a*, and is continued to the solid portion 21'. Namely, the locally vibratory portion 22 is connected in series to the solid portion 21' with respect to the sticks beating the flat surface 21***a*. When a drummer strikes the drum head 2, the solid portion 21' caves in, and presses the pillars 23 therebeneath against the base plate 25. Then, the pillars 23 are buckled. Although the pillars 23 around the buckled pillars 23 are slightly deformed, the other pillars 23 are not deformed, and keep themselves straight. Thus, a few pillars 23 are buckled. The solid portion 21' consumes part of the impact load by caving in, and the energy is converted to heat through the internal friction. The buckling also consumes other part of the impact load, and the other part of the impact load is accumulated in the accumulating portion 22 as the elastic strain energy. The elastic strain energy is released through the vibrations of the pillars 23. This means that the vibration energy is transmitted from the vibrating pillars 23 to the air therearound. This results in a faint noise.

The head body further has a resilient portion 21*b* and a rigid portion 21*c*. The rigid portion 21*c* has a ring-shape, and is larger in diameter than the solid portion 21'. The resilient portion 21*b* is connected between the rigid portion 21*c* and the solid portion 21'. In other words, the solid portion 21' is supported by the rigid portion 21*c* by means of the resilient portion 21*b*. In this instance, the solid portion 21', accumulating portion 22, resilient portion 21*b* and rigid portion 21*c* form a monolithic structure, and are concurrently shaped through the molding.

The rigid portion 21*c* includes a rim 24, which is downwardly bent from the remainder, and a metal ring 26 is embedded in the rim 24. In this instance, the shell 1 is cylindrical, and the drum head 2 is pressed to the shell 1 by means of the rim 3. Accordingly, the rigid portion 21*c* is formed with a step where the rim 3 is pressed. If a shell, a rim and tension a regulator are different from those of the drum shown in FIG. 1, the rigid portion is to be designed differently. The metal ring 26 reinforces the rim 24. The inner diameter of the rim 24 is equal to the outer diameter of the shell 1, and the shell 1 is capped with the rim 24.

The resilient portion 21*b* makes the solid portion 21' and locally vibratory portion 22*a* moved in the up-and-down direction at the beats on the solid portion 21'. When the drummer strikes the solid portion 21' with the stick, the resilient portion 21*c* is deformed so as to permit the solid portion 21' and locally vibratory portion 22*a* to sink, and part of the impact load is accumulated in the resilient portion 21*b* as the elastic strain energy. The elastic strain energy is released through the vibrations of the solid/locally vibratory portions 21'/22. The vibrations give rise to the feeling at the beats. The resilient portion 21*b* is designed to make the drummer feel the restitution similar to that of the ordinary drum head, i.e., a standard drum head without any damping layer. The width, thickness and modulus of elasticity of the resilient portion 21*b* are optimized for the feeling at the beats. The base plate 25 and pillars 23 are influential in creating the feeling at the beats. The base plate 25 imparts the inertia, and the pillars 23 give the restitution through the solid portion 21'. The material, the arrangement of pillars 23 and the shape of pillars 23 have the influence on the feeling at the beats on the drum head. However, the main factor is the resilient portion 21*c*.

Figure 2:
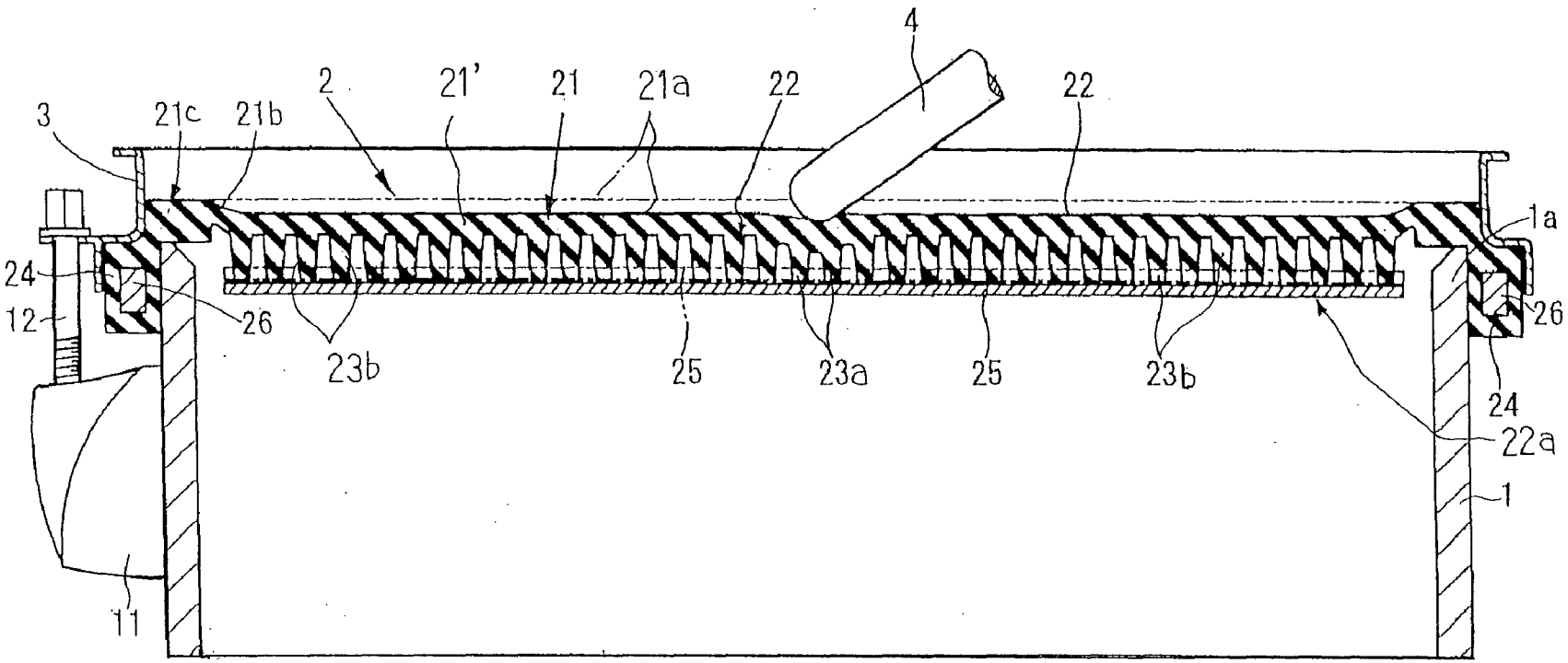
FIG. 2 is a cross sectional view showing the behavior of the drum head at a hit with a stick.
Figure 3:
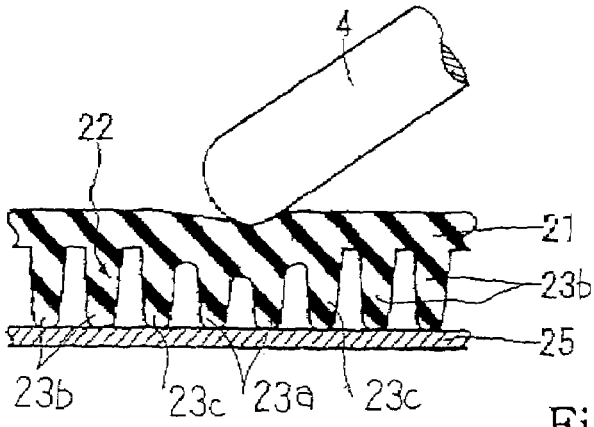
FIG. 3 is a cross sectional view showing pillars beneath the stick.

Assuming now a drummer strikes the flat surface 21*a* with a stick 4 (see FIG. 2). The solid portion 21' caves in, the solid portion/locally vibratory portions 21'/22 sink from the position indicated by dots-and-dash lines to the real lines, and the pillars 23*a* are buckled on the base plate 25. However, the buckled pillars 23*a* are beneath the stick 4. The pillars 23*b*, which are spaced from the pillars 23*a*, are not deformed. The pillars 23*c* may be resiliently deformed around the buckled pillars 23*a*. The pillars 23 are made of the elastomer, which has the large elongation. For this reason, a fairly large amount of elastic strain energy is accumulated in the deformed pillars 23*a*/23*c*. Those pillars 23*a*, 23*b*, 23*c* are illustrated in FIG. 3.

The solid portion 21' caves in, and does not cause the stick 4 to strongly jump. The drummer feels the stick 4 same as that at the beats on the ordinary drum head. The solid/locally vibratory portions 21'/22 do not incline, but uniformly sink, because the base plate 25 keeps, itself flat. Although the gap between, the dots-and-dash lines and the real lines is wide in FIG. 2, the displacement of the solid portion/locally vibratory, portion 21'/22*a* is small.

This is because of the fact that the pillars 23*a* accumulate a large amount of the elastic strain energy. Thus, the impact load is converted to the elastic strain energy, and the elastic strain energy is accumulated in the solid portion 21', pillars 23*a*/23*c* and resilient portion 21*b*.

The drummer lifts the stick 4 over the drum head 2. Then, the elastic strain energy is released from the solid portion 21', pillars 23*a*/23*c* and resilient portion 21*b*, and noise is head from the drum head 2. However, the noise is faint. The reason for the faint noise is hereinafter described in detail.

The depressed solid portion 21' is recovered to the initial state, and vibrates. However, the vibrations are rapidly damped. Only a part of the elastic strain energy is accumulated in the depressed solid portion 21', and the solid portion 21' is made of the elastomer, which has the large damping factor. For this reason, the elastic strain energy is quickly consumed, and the noise is faint. Moreover, any friction sound is never generated through the vibrations of the solid portion 21', because the molecules are strongly bonded over the solid portion 21'.

Figure 4:
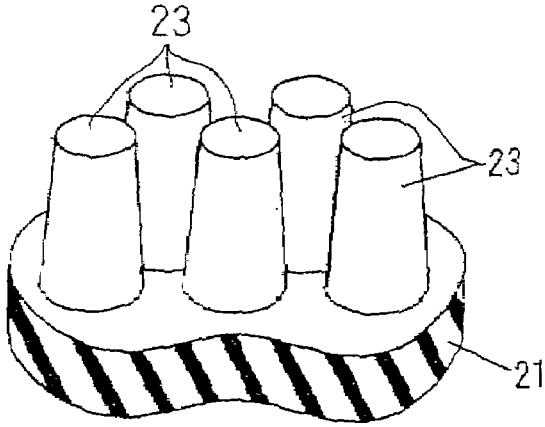
FIG. 4 is a perspective view showing the pillars of the head body which is turned over.
Figure 1:
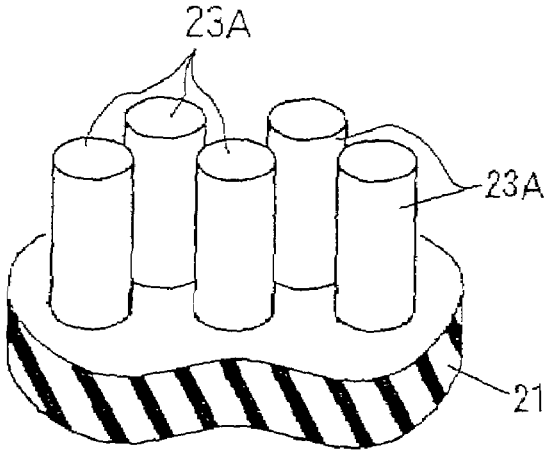

The deformed pillars 23*a*/23*c* are also recovered to the initial state, and vibrate. In this instance, the pillars 23 have been shaped into the frustum of cone as shown in FIG. 4, and the deformed pillars 23*a*/23*c* are recovered to the initial shape through the vibrations. Only a small number of pillars 23*a*/23*c* participate in the transmission of the energy to the air. Moreover, the vibrating air merely fills the narrow gap between the solid portion 21' and the base plate 25. For this reason, the noise is faint.

The resilient portion 21*c* is recovered to the initial state, and gives rise to the up-and-down motion of the solid/locally vibratory portions 21'/22. The base plate 25 increases the inertia of the vibrating body, and the up-and-down motion is close to that of the ordinary drum head. The drummer feels the restitution at the stick 4 close to that of a stick on the ordinary drum head. The vibrations are damped due to the internal friction, and the energy is transmitted through the vibrating solid/locally vibratory portions 21'/22 to the air. However, the vibration frequency is less than the audio range or close to the lower limit of the audio range. For this reason, the noise is less offensive to the ear.

As will be understood from the foregoing description, the drum head has the solid portion 21' and locally vibratory portion 22. The solid portion 21' is durable, and, accordingly, the drum head according to the present invention has a long lifetime. The impact load is accumulated in the solid portion 21' and locally vibratory portion 22. The substantial part of the impact load is locally accumulated in the accumulating portion 22 as the elastic strain energy, and the elastic strain energy gives rise to vibrations of the locally vibratory portion. Only a small amount of the air is in contact with the locally vibrating portion, and the locally vibrating portion drives the small amount of the air to vibrate. This results in the faint noise. In other words, the drum head implementing the first embodiment achieves the good muting characteristics without sacrifice of the durability.

Moreover, the solid/locally vibratory portions 21'/22 are connected to the rigid portion 21*c* through the resilient portion 21*b*. The resilient portion 21*b* permits the solid/locally vibratory portion 21'/22 to vibrate at the frequency lower than or close to the audio range, and makes the drummer feel the restitution on the drum head close to that on the ordinary drum head. Thus, the drum head implementing the first embodiment gives the good feeling close to that on the ordinary drum head.

Second Embodiment

Figure 5:
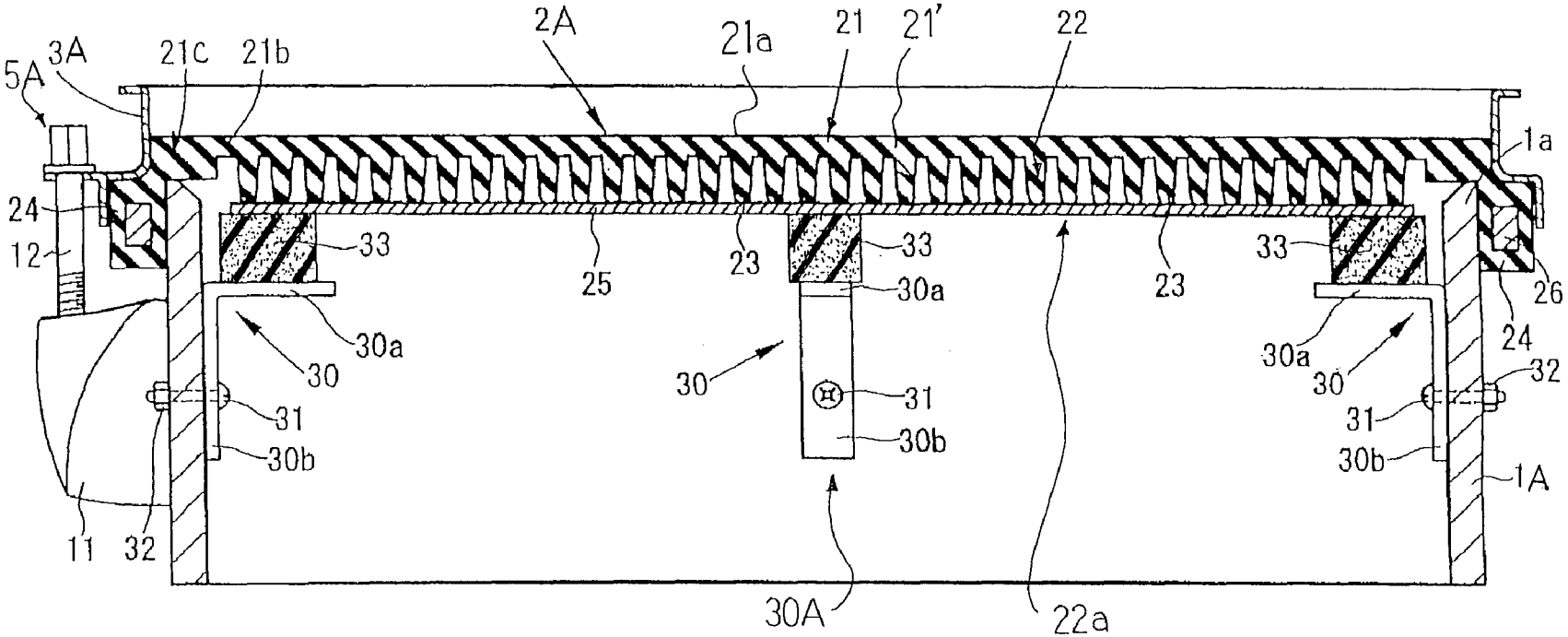
FIG. 5 is a cross sectional view showing the structure of another drum according to the present invention.

FIG. 5 shows another drum embodying the present invention. The drum comprises a shell 1A, a drum head 2A, a rim 3A, a tension regulator 5A and a supporter 30A. The shell 1A, drum head 2A, rim 3A and tension regulator 5A are similar to those 1, 2, 3 and 5 of the first embodiment, and, for this reason, the other component parts and portions are labeled with the references designating the corresponding parts and portions of the drum shown in FIG. 1 without detailed description.

The supporter 30A includes plural supporting brackets 30. The supporting brackets 30 are spaced at regular intervals, and are secured to the inner surface of the shell 1A. An angle plate 30*a*/30*b*, a bolt 31 and a cushion 33 form in combination each of the supporting brackets 30. The angle plate has a horizontal portion 30*a* and a vertical portion 30*b*, and the vertical portion 30*b* is secured to the inner surface of the shell 1A by means of the bolt 31. The cushion 33 is made of sponge, soft synthetic resin or rubber, and is adhered to the horizontal portion 30*a*. The base plate 25 is mounted on the cushions 33, and the cushions 33 softly press the base plate 25 to the array of pillars 23. Thus, the supporting brackets 30 sustain the base plate 25, and prevent the base plate 25 from falling. Moreover, the total weight of the solid/locally vibratory portions 21'/22 is shared between the resilient portion 21*b* and the supporting brackets 30. The bending moment exerted on the resilient portion 21*b* is reduced so that the resilient portion 21*b* is less liable to be broken. When a drummer strikes the solid portion 21' with a stick, the impact load is accumulated in the solid portion 21', accumulating portion 22, resilient portion 21*b* and cushions 33 in the form of elastic strain energy. The solid portion 21' and accumulating portion 22 behave as similar to those of the first embodiment, and prevent the drummer from the noise offensive to the ear.

The elastic strain energy is released from the resilient portion 21*b* and cushions 33, and the resilient portion 21*b* and cushions 33 permit the solid/locally vibratory portion 21'/22*a* to move the up-and-down direction as similar to the resilient portion 21*b* of the first embodiment. The resilient portion 21*b* and cushions 33 make the drummer feel the drum head 2A same as the ordinary drum head. Thus, the drum head 2A achieves all the advantages of the drum head 2, and the lifetime is prolonged.

Third Embodiment

Figure 6:
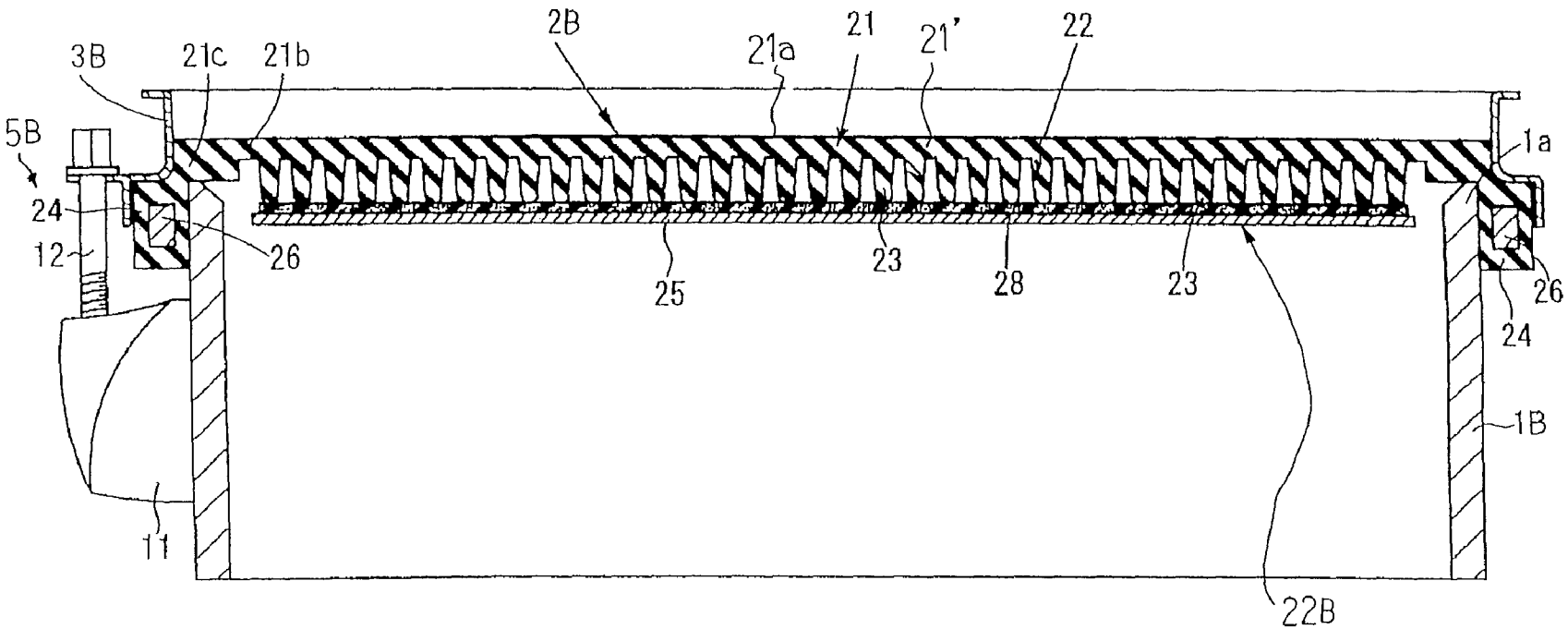
FIG. 6 is a cross sectional view showing the structure of yet another drum according to the present invention.

FIG. 6 shows yet another drum embodying the present invention. The drum implementing the third embodiment comprises a shell 1B, a drum head 2B, a rim 3B and a tension regulator 5B. The shell 1B, rim 3B and tension regulator 5B are similar to those 1, 3 and 5 of the first embodiment, and component parts and portions are labeled with the references designating corresponding component parts and portions of the drum shown in FIG. 1 without detailed description.

The drum head 2B includes the solid portion 21', rigid portion 21*c*, resilient portion 21*b* and a locally vibratory portion 22B. The solid portion 21', rigid portion 21*c* and resilient portion 21*b* are similar to those of the drum head 2, and no further description is hereinafter incorporated for the sake of simplicity. The locally vibratory portion 22B also includes an accumulating portion 22 and base plate 25, and an intervening sheet 28 is added to the locally vibratory portion 22B. The pillars 23 are adhered to the upper surface of the intervening sheet 28, and the base plate 25 is adhered to the lower surface of the intervening sheet 28. The intervening sheet 28 is made of the elastomer. Although the contact area between the pillars 23 and the intervening sheet 28 is narrow, the intervening sheet 28 is strongly adhered to the pillars 23, because the intervening sheet 28 is same in material as the head body 21. The base plate 25 is different in material from the intervening sheet 28. However, the base plate 25 is strongly adhered to the intervening sheet 28. This is because of the fact that the entire upper surface of the base plate 25 is adhered to the entire surface of the intervening sheet 28, i.e., the contact area is increased.

Thus, the intervening sheet 28 enhances the adhesion between the base plate 25 and the head body 21, and prevents the base plate 25 from falling. The intervening sheet 28 is economical rather than the supporter 30A, and the assembling work is made simple. The intervening sheet 28 of the elastomer further reduces the noise. The drum head 2B exhibits the good muting characteristics and restitution like that of the ordinary drum head.

Fourth Embodiment

Figure 7:
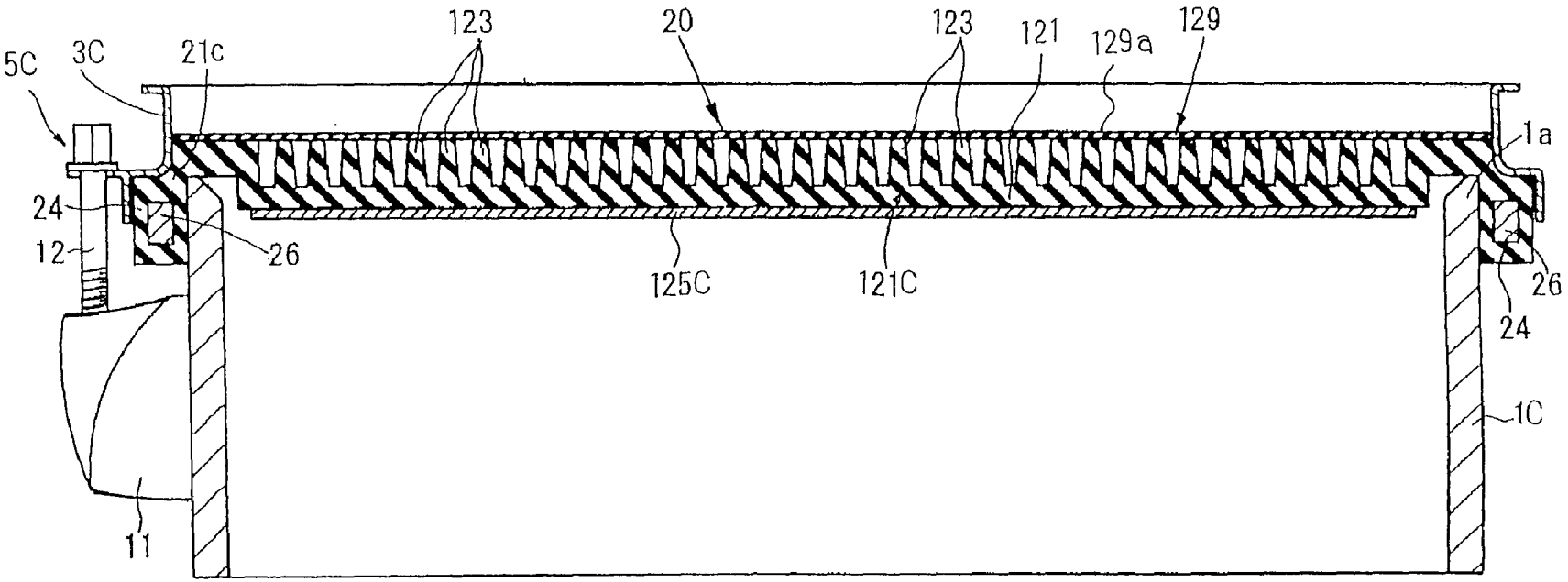
FIG. 7 is a cross sectional view showing the structure of still another drum according to the present invention.

FIG. 7 shows still another drum embodying the present invention. The drum implementing the fourth embodiment comprises a shell 1C, a drum head 20, a rim 3C and a tension regulator 5C. The shell 1C, rim 3C and tension regulator 5C are similar to the shell 1, rim 3 and tension regulator 5. For this reason, detailed description is omitted for avoiding repetition.

The drum head 20 comprises a head body 121C, a base plate 125C and a cover sheet 129. The head body 121C is made of elastomer, and a lot of pillars 123 are upright on a boss portion 121 at regular pitches. The cover sheet 129 is made of elastomer, and is adhered or fusion bonded to the tips of the pillars 123. The cover sheet 129 offers a surface 129*a* to be beaten with sticks to drummers. The cover sheet 129 is to be more durable than the head body 121C, and is to give good restitution to the sticks. In this instance, the cover sheet 129 is made of synthetic rubber.

The base plate 125C is similar to the base plate 25, and is adhered or fusion bonded to the lower surface of the boss portion 121. The contact area between the head body 121C and the base plate 125C is wider than the contact area between the head body 21 and the base plate 25, and the base plate 125C is hardly fallen from the head body 121C.

Figure 8:
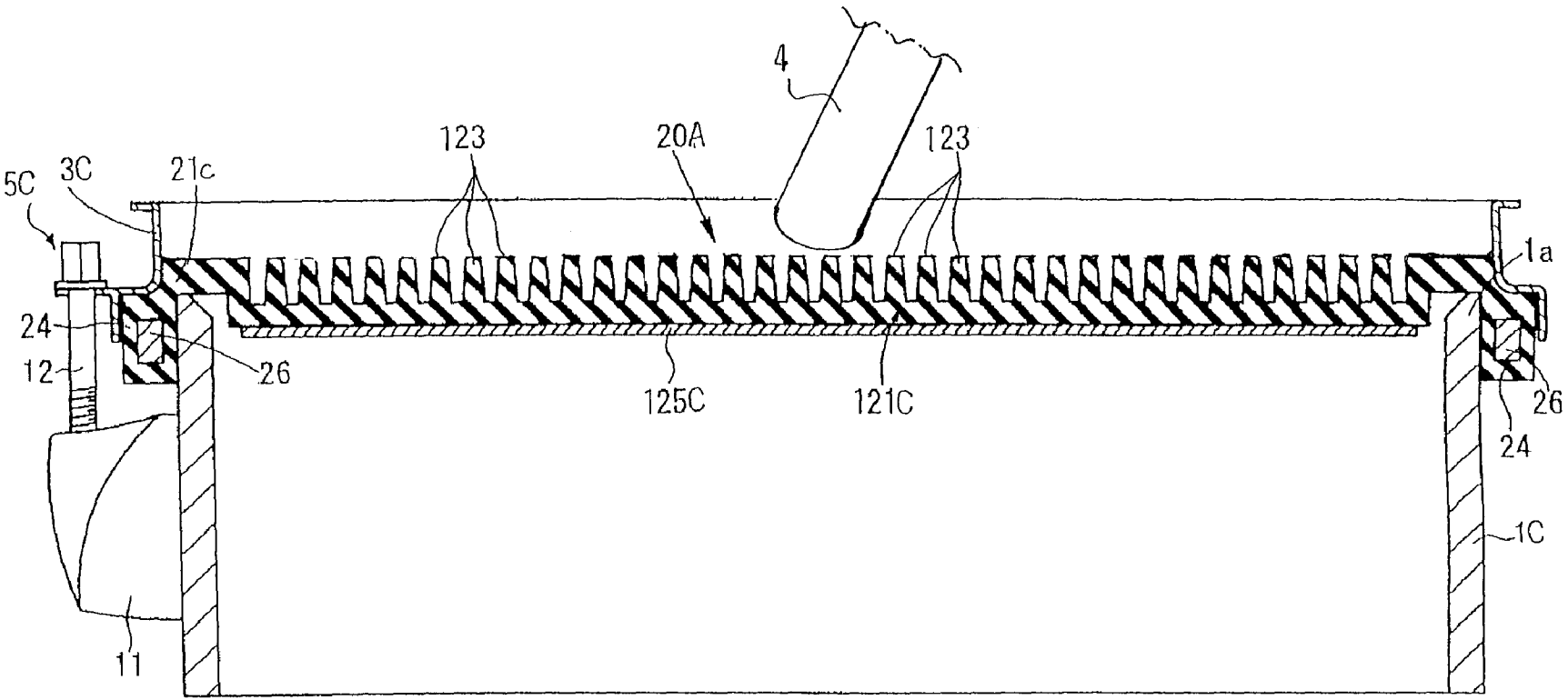
FIG. 8 is a cross sectional view showing the structure of a modification of the drum shown in FIG. 7.

The cover sheet 129 is expected to prevent the sticks from being pinched between the pillars 123, and is less expected to cave in. The impact load is mainly accumulated in the buckled pillars 123, and the elastic strain energy is released from the buckled pillars 123 through the vibrations. The contact area between the vibrating pillars 123 and the air is so narrow that the noise is faint. Thus, the cover sheet 129 is not the indispensable element of the drum according to the present invention. If the pillars, 123 are formed at high dense as shown in FIG. 8, the stick 4 is never dropped into the gap among the pillars 123. For this reason, the cover sheet 129 is removed from the drum head 20A.

Fifth Embodiment

Figure 9:
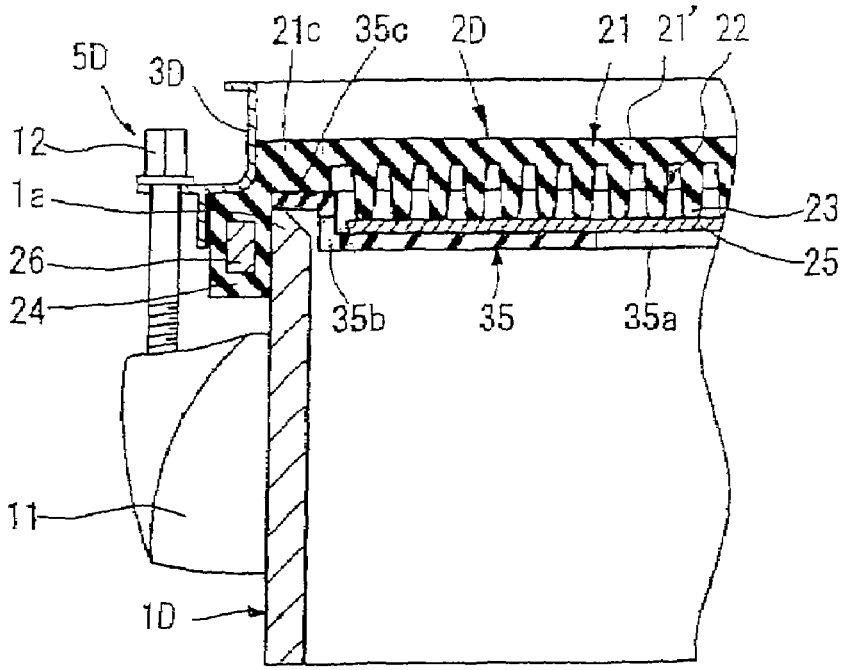
FIG. 9 is a cross sectional view showing the structure of yet another drum according to the present invention.

FIG. 9 shows yet another drum embodying the present invention. The drum implementing the fifth embodiment comprises a shell 1D, a drum head 2D, a rim 3D and a tension regulator 5D. The shell 1D, rim 3D and tension regulator 5D are similar to the shell 1, rim 3 and tension regulator 5, and no further description hereinafter incorporated for the sake of simplicity. Component parts of the shell 1D, rim 3D and tension regulator 5D are labeled with the references designating corresponding component parts of those incorporated in the first embodiment.

The drum head 2D includes the head body 21 and base plate 25, and a protection sheet 35 is added to the drum head 2D. The protection sheet 35 is made of elastomer, and has a disc shape. The base plate 25 and rigid portion 21*c* are covered with the protection sheet 35, and the peripheral portion 35*c* of the protection sheet 35 is adhered to the lower surface of the rigid portion 21*c*. The peripheral portion 35*c* is pinched between the upper edge 1*a* of the shell 1D and the rigid portion 21*c* of the head body 2D. The protection sheet 35 is formed with a center hole 35*a* and an air-vent 35*b*. The air-vent 35*b* extends around the array of pillars 23, and permits the head body 21 to be smoothly deformed at the beats.

The protection sheet 35 prevents the base plate 25 from falling. Even if the base plate 25 is not adhered to the pillars 23, the protection sheet 35 keeps the base plate 25 and pillars 23 held in contact with each other. Thus, the protection sheet 35 prolongs the lifetime of the drum head 2D.

In this instance, the protection sheet 35 is made of elastomer, and part of the impact load is accumulated in the protection sheet 35. This means that the solid portion 21' is not expected to cave in as deep as the solid portion 21' of the drum 2. The designer may make the head body 21 and protection sheet 35 of different sorts of elastomer. The designer may select a certain sort of elastomer, which is larger in hardness than the elastomer for the protection layer 35, for the head body 21. In this instance, the solid portion 21' makes the stick 4 widely jump so that the drummer feels the stick as light as the stick rebounding on the ordinary drum head. On the other hand, the designer may select another sort of elastomer for the protection sheet 35. The sort of elastomer is to exhibit good resiliency against the aged deterioration.

Sixth Embodiment

Figure 10:
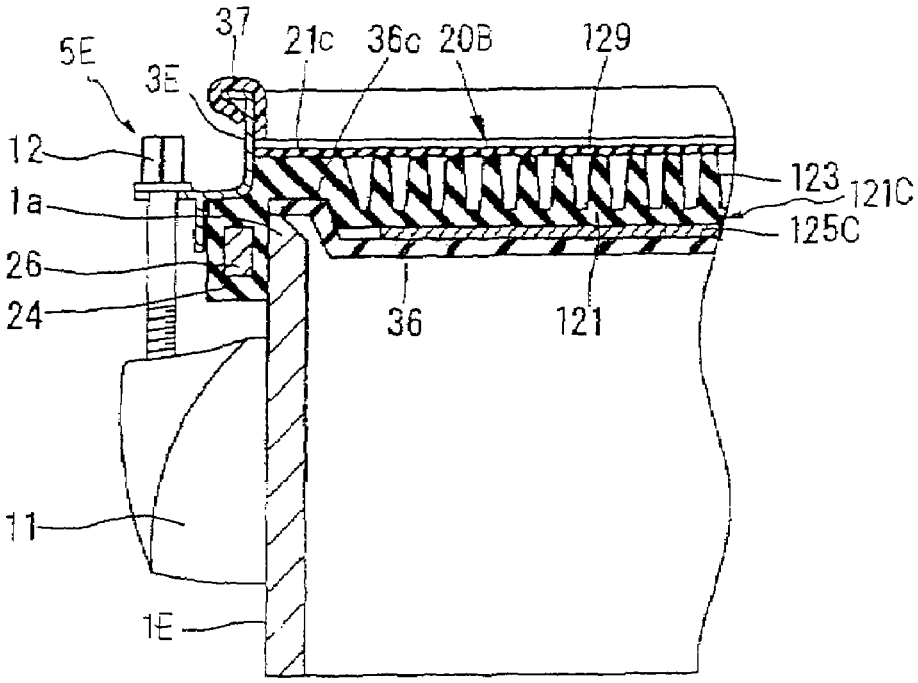
FIG. 10 is a cross sectional view showing the structure of still another drum according to the present invention.

FIG. 10 shows yet another drum embodying the present invention. The drum implementing the sixth embodiment comprises a shell 1E, a drum head 20B, a rim 3E and a tension regulator 5E. The shell 1E and tension regulator 5E are same as the shell 1C and tension regulator 5C. Component parts of the shell 1E and tension regulator 5D are labeled with the references designating corresponding component parts of those incorporated in the fourth embodiment.

The rim 3E is covered with a rim cover 37, which is made of synthetic resin or synthetic rubber. The drum head 20B is similar to the drum head 20 (see FIG. 7) except that the head body 121C is covered with a protection sheet 36 as similar to the drum head 2D. The protection sheet 36 has the resiliency; and prevents the base plate 25 from falling.

In this instance, the protection sheet 36 is made of elastomer, and the peripheral portion 36*c* of the protection sheet 36 is adhered to the lower surface of the rigid portion 21*c*. Any hole is not formed in the protection sheet 36, because the boss portion 121 is not deformed so wide as that of the head body 20. However, the peripheral portion 36*c* may not be adhered to the lower surface, and the protection sheet 36 may be formed with a center hole and an air-vent. The rim cover 37 may be removed from the rim 3E.

The drum implementing the sixth embodiment exhibits good muting characteristics, and gives the drummer the feeling close to that at the beats on the ordinary drum head.

Seventh Embodiment

Figure 11:
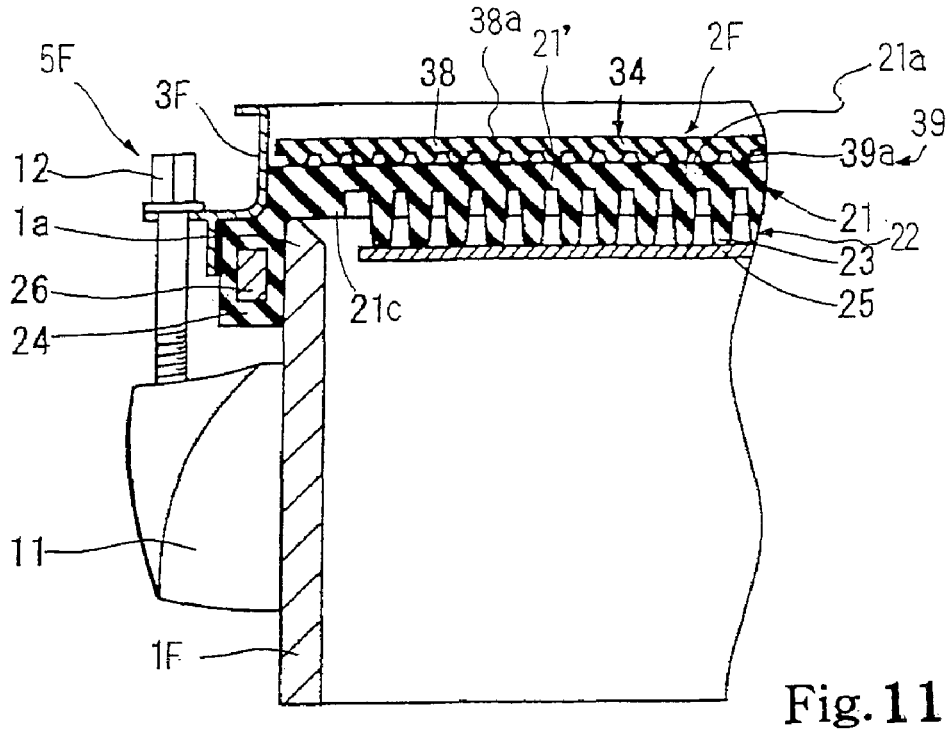
FIG. 11 is a cross sectional view showing the structure of yet another drum according to the present invention.

FIG. 11 shows still another drum embodying the present invention. The drum implementing the seventh embodiment comprises a shell 1F, a drum head 2F, a rim 3F and a tension regulator 5F. The shell 1F, rim 3F and tension regulator 5F are same as those of the first embodiment, and, for this reason, component parts of the shell 1F, rim 3F and tension regulator 5F are labeled with the references designating corresponding component parts of those incorporated in the first embodiment.

The drum head 2F includes the head body 21' and base plate 25, and the head body 21 has the solid portion 21', accumulating portion 22 and rigid portion 21*c* as similar to the drum head 2. The drum head 2F further includes another head body 34, and the head body 34 is placed on the upper surface 21*a* of the head body 21. The drum head 34 has a disc-like configuration. The head body 34 is made of elastomer, and also has a solid portion 38 and an accumulating portion 39. However, the head body 34 has neither rigid portion 21*c* nor resilient portion 21*b*.

The solid portion 38 offers a flat surface to be beaten with sticks to drummers, and the accumulating portion 39 is implemented by an array of pillars 39*a*. In this instance, the pillars 39*a* are a frustum of cone. The solid portion 38 is constant in thickness, and the pillars 39*a* are approximately equal in height to one another. The pillars 39*a* are adhered to or fusion bonded to the solid portion 21'.

When a drummer strikes the flat surface 38*a* with a stick, the solid portion 38 caves in, and the pillars 39*a* beneath the cave are deformed so that the impact load is partially accumulated in the deformed pillars 39*a*. The elastic strain energy is released through the vibrations of the deformed pillars 39*a* so that the noise is faint. In case where the impact load is large, the pillars 23 may participate in the consumption of the elastic strain energy. The head body 34 is monolithic, and the flat surface 38 does not have any hole where the stress is concentrated. For this reason, the head body 34 is durable. As will be understood, the head body 34 or bodies 21/34 make the noise at the beats faint, and the head body 34 prolongs the lifetime of the drum head 2F.

The elastomer for the head body 34 may be different from the elastomer for the head body 21. The manufacturer may make the head body 34 of a certain sort of elastomer which gives rise to suitable restitution close to the restitution at the beats on the ordinary drum head. On the other hand, the manufacturer may make the head body 2F of another sort of elastomer which gives good durability to the head body 2F.

Eighth Embodiment

Figure 12:
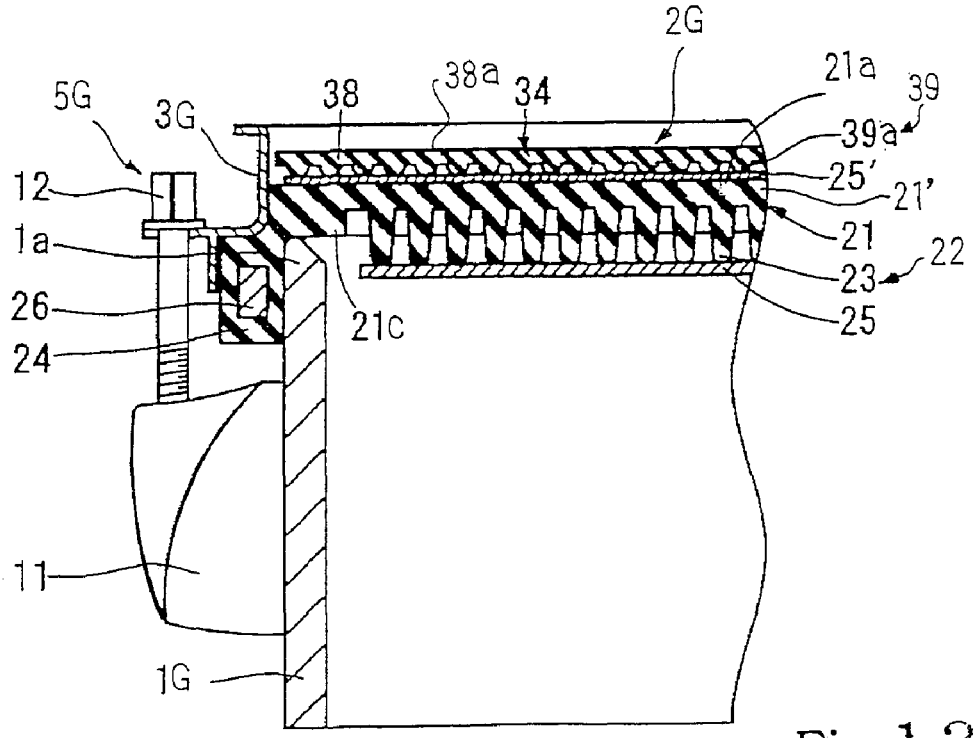
FIG. 12 is a cross sectional view showing the structure of still another drum according to the present invention.

FIG. 12 shows yet another drum embodying the present invention. The drum embodying the present invention comprises a shell 11G, a drum head 2G, a rim 3G and a tension regulator 5G. The shell 1G, rim 3G and tension regulator 5G are same as those of the first embodiment, and, for this reason, component parts of the shell 1G, rim 3G and tension regulator 5G are labeled with the references designating corresponding component parts of those incorporated in the first embodiment.

The drum head 2G includes the head body 21 and base plate 25, and the head body 21 has the solid portion 21', accumulating portion 22 and rigid portion 21*c* as similar to the drum head 2. The drum head 2G further includes the head body 34 and an intervening plate 25'. The head body 34 is same as that incorporated in the seventh embodiment, and detailed description is omitted for avoiding repetition.

The intervening plate 25' has a disc shape, and is held in contact with the array of pillars 39*a*. The intervening plate 25' has a rigidity larger than that of the head bodies 34 and 21. The array of pillars 39*a* is adhered or fusion bonded to the upper surface of the intervening plate 25', and the solid portion 21' is adhered or fusion bonded to the lower surface of the intervening plate 25'. The intervening plate 25' enhances the durability of the drum head 2G together with the head body 34. Moreover, the intervening plate 25' makes the pillars 39*a* buckled thereon. Thus, the intervening plate 25' is conducive to the accumulation of a large amount of elastic strain energy.

The manufacture may form the intervening plate 25' of a certain sort of material different from that for the base plate 25. The material for the intervening plate 25' may exhibit a large damping factor for consuming part of the elastic strain energy through the vibrations. However, the material may not have a large flexural strength. This is because of the fact that there is the head body 21 beneath the head body 34. On the other hand, a large flexural strength may be required for the base plate 25. However, the material for the base plate 25 may not have a large damping factor.

Electronic Drum System

The drums shown in FIGS. 1 to 12 are available for an electronic drum system. A vibration sensor unit is attached to the drum head 2, 2A, 2B, 20, 20A, 2D, 2E, 2F or 2G, and is connected to an electronic drum sound generator. A drum equipped with the vibration sensor unit is hereinafter referred to as an "electronic drum". The electronic drum is an essential component of the electronic drum system.

Figure 13:
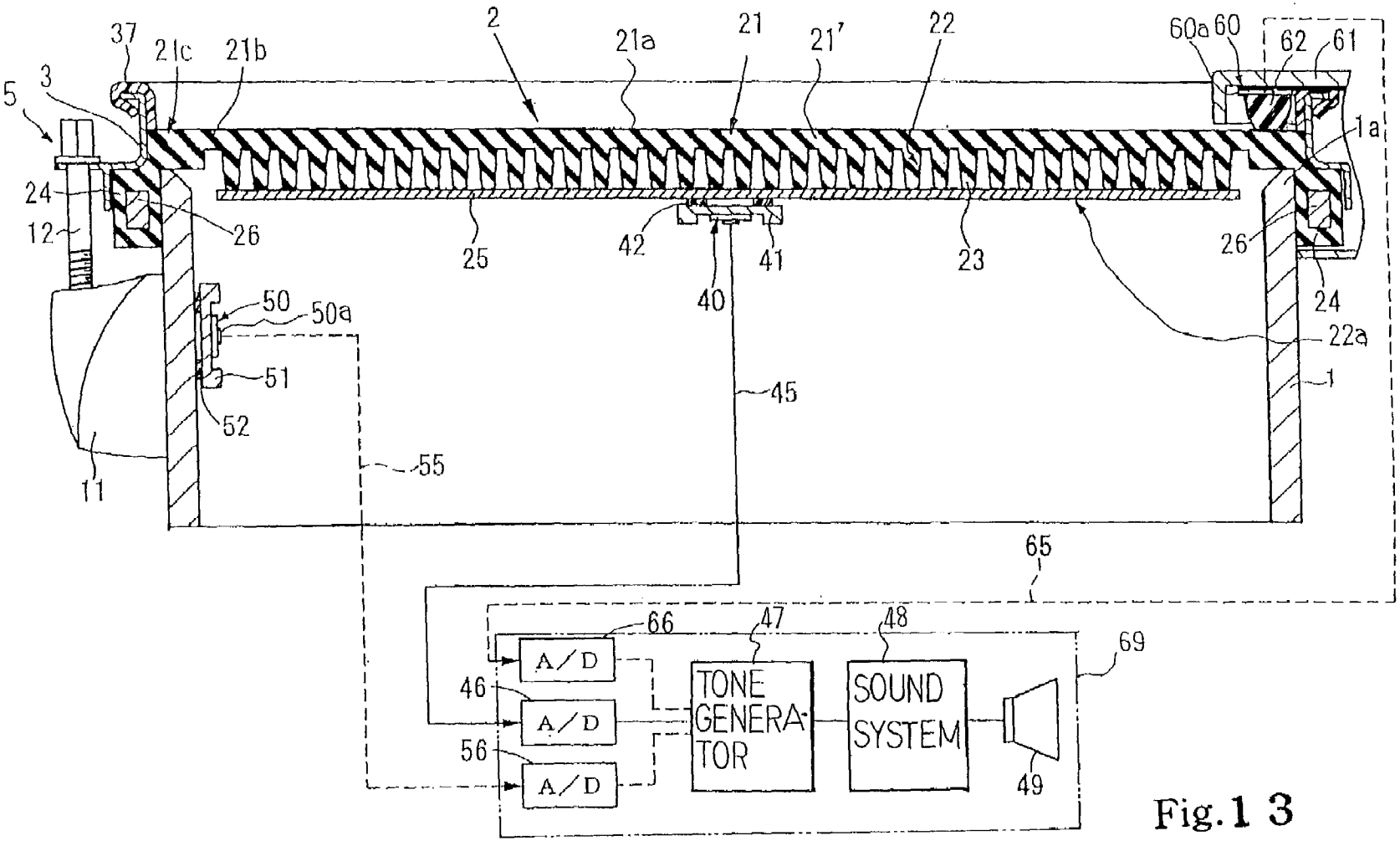
FIG. 13 is a block diagram showing the system configuration of an electronic drum according to the present invention.
Figure 14:
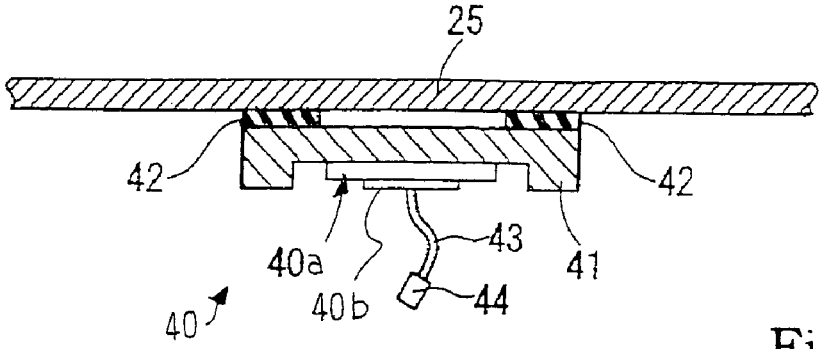
FIG. 14 is a cross sectional view showing the structure of a vibration sensor incorporated in an electronic drum forming a part of the electronic drum system.

FIG. 13 shows an electronic drum system according to the present invention. An electronic drum is fabricated on the basis of the drum shown in FIG. 1. A difference from the drum shown in FIG. 1 is a rim cover 37. The upper edge of the rim 3 is covered with the rim cover 37, and a drummer gives rim shots onto the rim cover 37. The other components of the are labeled with the references designating the corresponding components of the drum shown in FIG. 1 without detailed description for the sake of simplicity.

The electronic drum further comprises vibration sensors 40, 50 and 60, and the electronic drum and an electronic sound generating system 69 form in combination an electronic drum system. In the following description, the beats on the drum head 2 and the shots on the rim cover 37 are referred to as "pad shots" and "rim shots", respectively. Although two sorts of rim shots, i.e., open rim shots and close rim shots, are given to the rim cover 37, the term "rim shots" stand for both of the open rim shots and close rim shots.

The vibration sensors 40 is secured to the lower surface of the base plate 25, and converts the pad shots to an electric signal representative of the waveform of the vibrations. The vibration sensor 50 is secured to the inner surface of the shell 1, and converts the rim shots to an electric signal representative of the vibrations. The vibration sensor 60 is secured to the lower surface of a sensor holder 61, which inwardly projects from the rim 3, and converts both pad and rim shots to an electric signal representative of the vibrations. Although the electronic drum shown in FIG. 13 has the three sensors 40/50/60, other electronic drums have one or two vibration sensors 40/50/60. Another electronic drum has only the vibration sensor 40, and the other vibration sensors 50 and 60 are removed from the electronic drum as indicated by broken lines in FIG. 13. Yet another electronic drum has the vibration sensor 40 for the pad shots and the vibration sensor 50 for the rim shots, and the vibration sensor 40 and vibration sensor 50 independently swing the electric signal at each pad shot and the other electric signal at each rim shot. Still another electronic drum is equipped with only the vibration sensor 60. The vibration sensor 60 swings the electric signal at each of the pad and rim shots.

The vibration sensor or sensors 40/50/60 supply the electric signal or signals through signal lines 45/55/65 to the electronic sound generating system 69. The electronic sound generating system 60 analyzes the electric signal or signals to see whether or not the drummer gives the pad/rim shot to the electronic drum. When the answer is given affirmative, the electronic sound generating system 69 produces an audio signal representative of electronic beats, and converts the audio signal to the electronic beats. The vibration sensors 40/50/60 and electronic sound generating system 69 are hereinafter described in more detail.

The vibration sensor 40 includes a piezoelectric converter 40*a*, a sensor boat 41 and a sheet of vibration absorber 42. The sensor boat 41 has a disc shape, and makes the vibrations equalized regardless of the spots beaten with the sticks. The vibration absorber 42 is shaped into a ring, and eliminates high-frequency noise components from the vibrations. The piezoelectric converter 40*a* includes a piece of piezoelectric crystal 40*b*, a lead 43 and a connector 44. The piece of piezoelectric crystal 40*b* is secured to the lower surface of the sensor boat 41, and the lead 43 is connected at one end thereof to the piece of piezoelectric crystal 40*b* and at the other end to the connector 44. The signal line 45 is connected through the connector 44 to the lead 43. The vibration absorber 42 is adhered to the peripheral area of the upper surface of the sensor boat 41, and is further adhered to the lower surface of the base plate 25. The piezoelectric converter 40*a* is located at the center of the lower surface of the base plate 25 so that the sensitivity is constant to the vibrations propagated from any area on the flat surface 21*a*.

Assuming now that a drummer strikes the flat surface 21*a* with the stick, the stick gives rise to vibrations of the drum head 2, and the vibrations are propagated to the vibration sensor 40*a* through the sheet of vibration absorber 42 and sensor boat 41. The vibration absorber 42 eliminates high-frequency noise components from the vibrations, and low frequency vibrations, which represent the shake at the impact and the up-and-down motion of the drum head 2, give rise to stain in the piece of piezoelectric crystal 40*b*. The piece of piezoelectric crystal 40*b* converts the strain to electric charge, and the electric charge is taken out from the vibration sensor 40 to the signal line 45.

The other vibration sensor 50 is secured to the inner surface of the shell 1 in a similar manner to the vibration sensor 40. A piezoelectric converter 50*a* is adhered to a sensor boat 51, and the sensor boat 51 is adhered to the inner surface through a sheet of vibration absorber 52.

The vibration sensor 60 includes a piezoelectric converter 60*a*, which is adhered to the lower surface of the holder 61. A, sheet of vibration absorber may be inserted between the holder 61 and the piezoelectric converter 60*a* for eliminating the noise components from the vibrations. The vibration sensor 60 further includes a vibration absorbing block 62, and the vibration absorbing block 62 is also expected to eliminate noise components from the vibrations. The vibration absorbing block 62 is adhered to the piezoelectric converter 60*a*, and is hung therefrom. The vibration absorbing block 62 is in contact with the flat surface 21*a* of the drum head 2.

When a drummer gives the rim shot, the vibrations are propagated through the rim 3 and holder 61 to the piezoelectric converter 60*a*, and give rise to the strain in the piezoelectric converter 60*a*. The piezoelectric converter 60*a* converts the strain to electric charge, and the electric charge is taken out to the signal line 65. On the other hand, when the drummer beats the drum head 2, the vibrations are propagated through the drum head 2 and vibration absorbing block 62 to the piezoelectric converter 60*a*. The noise components are eliminated from the vibrations, and the low-frequency components give rise to the strain in the piezoelectric converter 60*a*. The piezoelectric crystal converts the strain to electric charge, and the electric charge is taken out from the piezoelectric converter 60*a* as the electric signal. Thus, both pad and rim shots are detectable by means of the vibration sensor 60.

The electronic sound generating system 69 includes analog-to-digital converter 46, 56 and 66, a tone generator 47, a sound system 48 and loud speakers 49. The signal lines 45, 55 and 65 are connected between the vibration sensors 40, 50 and 60 and the analog-to-digital converters 46, 56 and 66. The electric signals arrive at the analog-to-digital converters 46, 56 and 66, respectively, and are converted to series of digital codes representative of the discrete values on the electric signals. Though not shown in FIG. 13, the tone generator 47 includes a microprocessor, plural read-out units and a waveform memory. Plural groups of pieces of waveform data are stored in the waveform memory. A group of pieces of waveform data is representative of a waveform of drum sound at the pad shot, and other groups of waveform data are representative of a waveform of drum sound at the rim shot. The microprocessor periodically checks the series of discrete values to see whether or not the drummer gives a pad/rim shot to the drum head/rim cover 2/37. While the drummer does not give any shot, the series of discrete values are not widely changed, and the microprocessor waits for a pad/rim shot. On the other hand, when the microprocessor finds the series of discrete values to express a pad/rim shot, the microprocessor assigns a read-out job to one of the read-out units. Thus, the read-out unit is triggered with the highest peak of the electric signal representative of the pad/rim shot. The pieces of waveform data are successively read out from the waveform memory, and a series of digital codes is converted to the audio signal. In case where the drummer concurrently gives the pad shot and rim shot, the microprocessor assigns the read-out job to plural read-out units, and the more than one series of digital codes is converted to the audio signal. In case where only the vibration sensor 60 is incorporated in the electronic drum, the microprocessor discriminates the pad shot from the rim shot through a data processing. The microprocessor may compare the peak value with a threshold for the pad shot and another threshold for the rim shot, and determines which shot is given by the drummer. Thus, the tone generator 47 is responsive to any sort of stick work.

The tone generator 47 is connected to the sound system 48, and the sound system 48 equalizes and amplifies the audio signal. The sound system 48 is responsive to a volume control dial, and varies the gain of the power amplifier. The audio signal is supplied from the sound system 48 to the loud speakers 49, and is converted to the electronic beats through the loud speakers 49.

Figure 15:
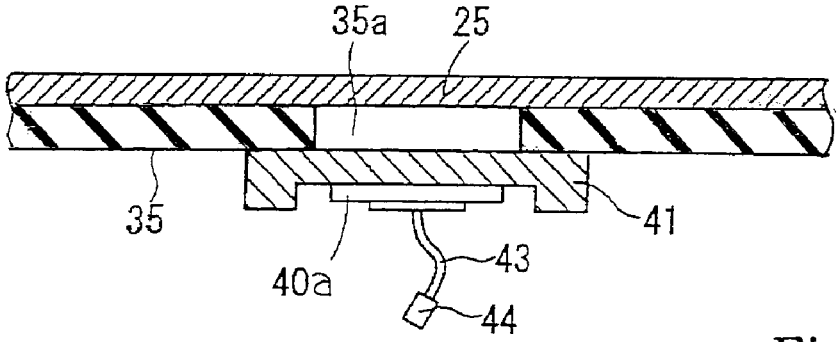
FIG. 15 is a cross sectional view showing the structure of a vibration sensor incorporated in another electronic drum.

As described hereinbefore, any drum embodying the present invention is available for the electronic drum and, accordingly, the electronic drum system. The drum shown in FIG. 9 is assumed to be used for the electronic drum. The base plate 25 is partially covered with the protection sheet 35, and the protection sheet 35 is formed with the center hole 35*a*. In this situation, the sensor boat 41 is directly adhered to the protection sheet 35 around the center hole 35*a*, and the piezoelectric converter 40*a* is adhered to the boat 41 by means of a piece of pressure sensitive adhesive sheet as shown in FIG. 15. The protection sheet 35 serves as a vibration absorber for eliminating the noise components from the vibrations.

Figure 16:
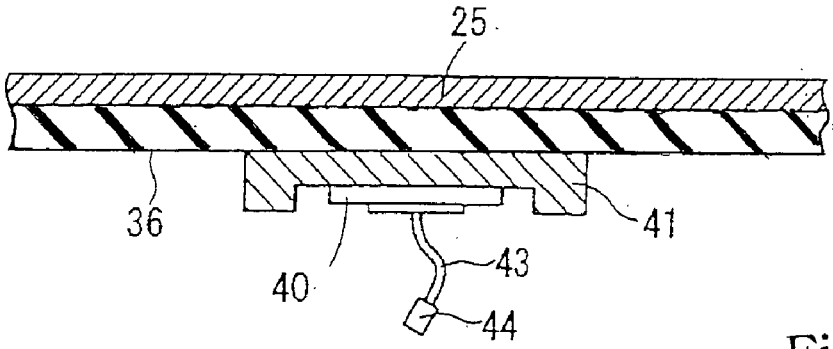
FIG. 16 is a cross sectional view showing the structure of yet a vibration sensor incorporated in yet another electronic drum.

In case where the electronic drum is fabricated on the basis of the drum shown in FIG. 10, the entire lower surface of the base plate 25 is covered with the protection sheet 36. In this situation, the protection sheet 36 is expected to serve as the vibration absorber, and the sensor board 41 is adhered to the lower surface of the protection sheet 36 as shown in FIG. 16.

As will be understood from the foregoing description, the vibration sensor or sensors 40/50/60 and drum according to the present invention form in combination the electronic drum, and the electronic sound generating system 69 is triggered with the peaks of the electric signals supplied from the vibration sensor or sensors 40/50/60. The drum head of the electronic drum is silent at the beats by virtue of the locally vibratory portion 22*a*, 22B, 123 or 39. Thus, the drummer enjoys his or her performance through the electronic beats without noise.

The drummer feels the stick work same as that on the ordinary drum head. The resilient portion 21*b*, protection sheet 35/36 and/or cover sheet 129 are conducive to the good feeling.

The boat 41/51 make the peak values immediately after the beats at different spots close. This feature is desirable, because the microprocessor easily discriminates the first peaks from the vibrations. Thus, the boat 41/51 is conducive to the missing shot.

Drum Set

The drums shown in FIGS. 1 to 12 form a drum set. Different sized drums of any one of the drums shown in FIGS. 1 to 12 may form the drum set. Otherwise, different sorts of drums may form the drum set. The drum or drums according to the present invention may be mixed with the ordinary drums.

Figure 17:
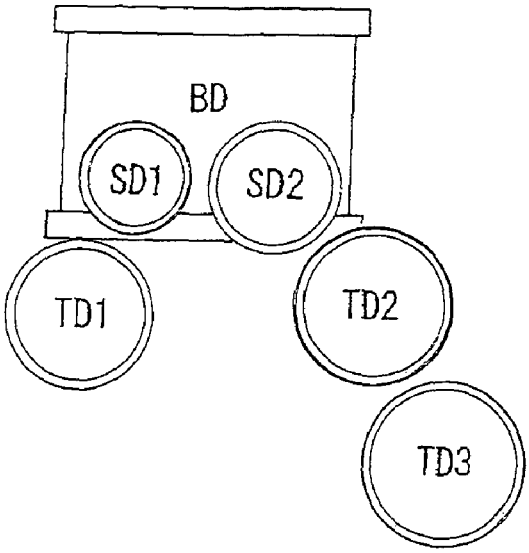
FIG. 17 is a plane view showing the system configuration of a drum set according to the present invention.

FIG. 17 shows a drum set according to the present invention. One of the drums has an external appearance close to a bass drum, and is labeled with "BD". Though not shown in the figure, a beater, on which the drummer steps, is provided for the drum BD. Two drums, which are labeled with "SD1" and "SD2", are like a snare drum, and the other drums "TD1", "TD2" and "TD3" have an external appearance analogous to a tam-tam. The drums SD1, SD2, TD1, TD2 and TD3 are arranged around a drummer, and the drum BD is placed on the floor in front of the drummer.

The drums according to the present invention are assumed to form the drum set. While a drummer is practicing the stick work on the drum set, the drummer selectively beats the drums SD1, SD2, TD1, TD2 and TD3 with the sticks, and steps on the foot pedal for beating the drum BD with the beater. The drums BD, SD1, SD2, TD1, TD2 and TD3 have the locally vibratory portions, and the impact load is consumed through the local vibrations. For this reason, the drums BD, SD1, SD2, TD1, TD2 and TD3 are silent, and the drummer practices the stick work without disturbance to the neighborhood.

Figure 18:
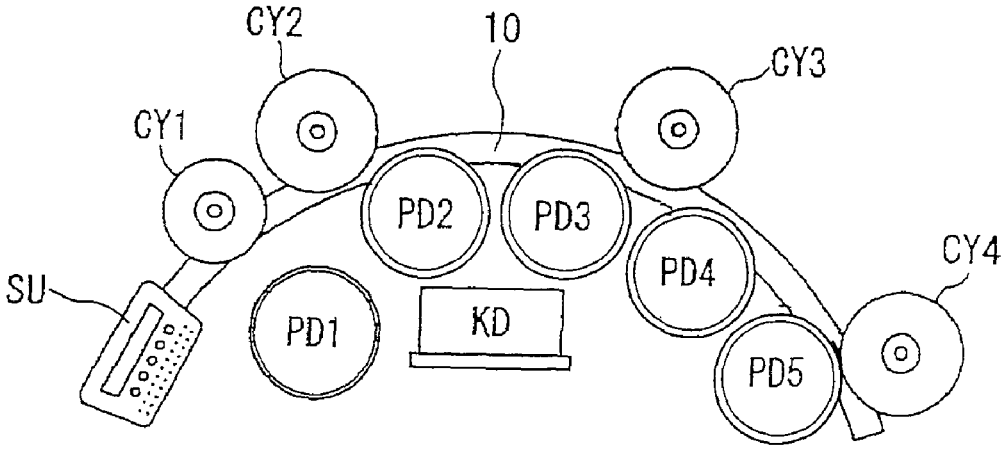
FIG. 18 is a plane view showing the system configuration of another drum set according to the present invention.

Similarly, the electronic drums form another drum set shown in FIG. 18. At least one of the electronic drums is fabricated on the basis of the drums shown in FIGS. 1 to 12. The electronic drums KD and PD1–PD5 and electronic cymbals CY1 to CY4 are incorporated in the electronic drum set. The electronic drum KD has an external appearance like a kick pad, and is placed on the floor. A beater is provided in front of a drummer, and the drummer steps on the foot pedal of the beater for beating the electronic drum KD. The electronic drums PD1 to PD5 are corresponding to snare drums. The electronic drum PD1 is put on a snare stand, and the other electronic drums PD2 to PD5 are supported by a drum rack 10. The electronic cymbals, in which an electronic hi-hat cymbal is incorporated, are also supported by the drum rack 10. The snare stand and drum rack 10 are upright on the floor around the drummer.

The electronic cymbals CY1–CY4 are another application of the present invention, and are another sort of silent percussion instrument. Pads, which have the structure similar to the drum head 2–2G, 20, 20B or 20C, are shaped into the configuration like the acoustic cymbal so that the electronic cymbals exhibit the good muting characteristics, durability and the feeling like that at the beats on the acoustic cymbals.

An electronic sound generating system SU is further incorporated in the electronic drum system. The electronic drums KD and PD1–PD5 and electronic cymbals CY1–CY4 share the electronic sound generating system SU with one another. In other words, the electronic sound generating system SU has plural data input ports, which are assigned to the electronic drums KD and PD1–PD5 and electronic cymbals CY1–CY4, respectively, and the waveform memory stores plural groups of waveform data for different sorts of electronic drum/cymbal sound. Plural time slots are assigned to the data input ports.

The microprocessor processes the series of discrete values in the time slot assigned to each of the electronic drums/cymbals KD, PD1–PD5 and CY1–CY4, and instructs one of the read-out units presently standing idle to read out a series of waveform data from the waveform memory. Thus, the microprocessor periodically checks the plural data input ports for the pad/rim shots, and processes the series of discrete values in the time-sharing fashion. The plural series of digital codes are mixed into a series of digital codes, and the audio signal is produced from the series of digital codes. The audio signal is supplied to the sound system for the equalization, amplification and volume control, and, thereafter, is supplied to the loud speakers. Though not shown in FIG. 18, a headphone is connectable to the sound system, and the drummer can hear the electronic drum/cymbal sound through the headphone.

As will be appreciated from the foregoing description, a drummer practices the stick work on the drum set shown in FIG. 17 without disturbance to the neighborhood. Moreover, when the electronic drums/cymbals are incorporated in the drum set, the drummer hears the electronic percussion sound through the loud speakers at a small volume or the headphone. The noise at the beats is faint so that the drummer enjoys their performances on the electronic drum set only through the electronic percussion sound.

Although particular embodiments of the present invention have been shown and described, it will be apparent to those skilled in the art that various changes and modifications may be made without departing from the spirit and scope of the present invention.

The shell 1, rim 3 and tension regulator 5 do not set any limit to the technical scope of the drum according to the present invention. Any sort of shell, rim and coupler is available for the drum according to the present invention. For example, a shell may have only one opening over which the drum head is stretched. Another shell may have a polygonal opening. The drum head may be connected to the shell by means of toggle joints instead of the lugs 11 and tuning bolts 12.

If user does not care about the feeling at the beats, the solid portion 21' may be directly connected to the rigid portion, and the solid portion 21', accumulating portion 22 and rigid portion 21*c* form in combination the head body.

The metal ring 26 does not set any limit to the technical scope of the present invention. The rigid portion 21*c* without the metal ring 26 may be strong enough to keep the head body on the shell of a small-sized drum.

Figure 20:
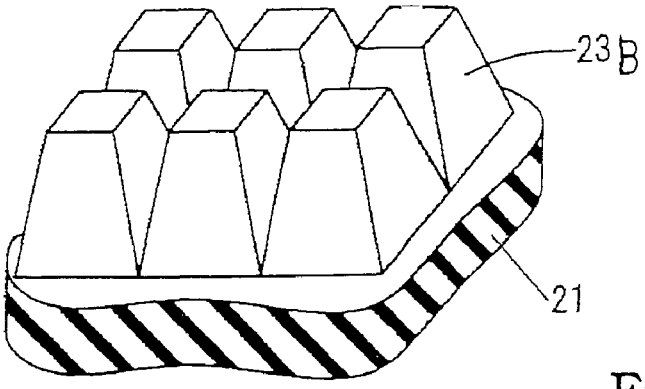
FIG. 20 is a perspective view showing pillars of yet another head body.
Figure 21:
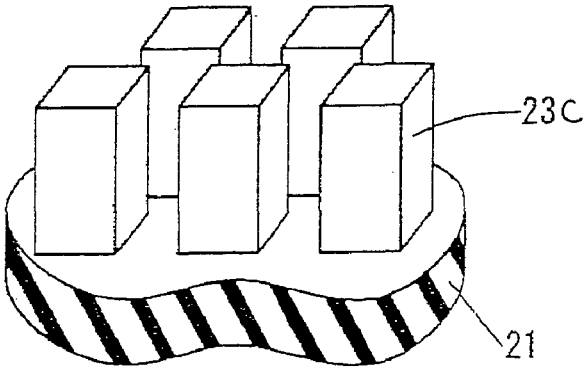
FIG. 21 is a perspective view showing pillars of still another head body.
Figure 22:
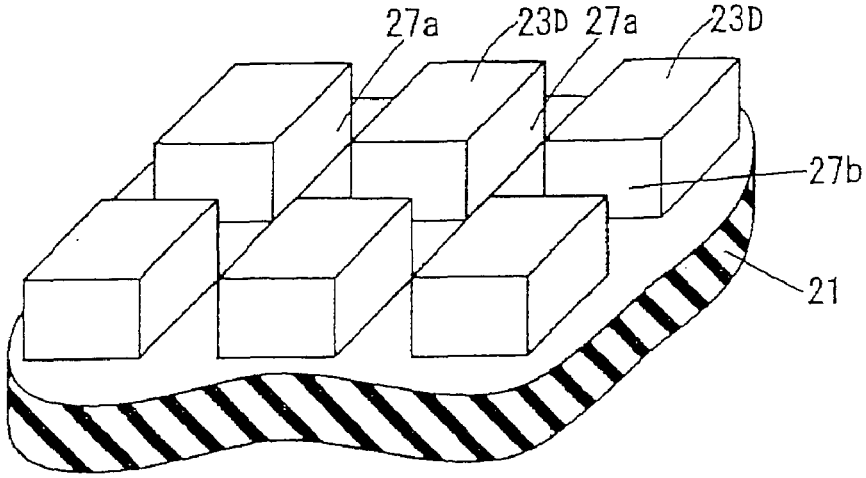
FIG. 22 is a perspective view showing pillars of yet another head body.

The frustum of cone (see FIG. 4) does not set any limit to the technical scope of the present invention. Column pillars 23A may be incorporated in a locally vibratory portion as shown in FIG. 19. Pillars 23B may be shaped into a frustum of pyramid as shown in FIG. 20. The pillars 23B are desirable for the molding process, because the molded products are smoothly taken out from the dies. Otherwise, square poles 23C may form an accumulating portion as shown in FIG. 21. Rectangular parallelepiped blocks 23D may be formed under the solid portion 21' as shown in FIG. 22. The rectangular parallelepiped blocks 23D may be realized by forming longitudinal grooves 27*a* and lateral grooves 27*b* crossing each other at right angle.

Figure 23:
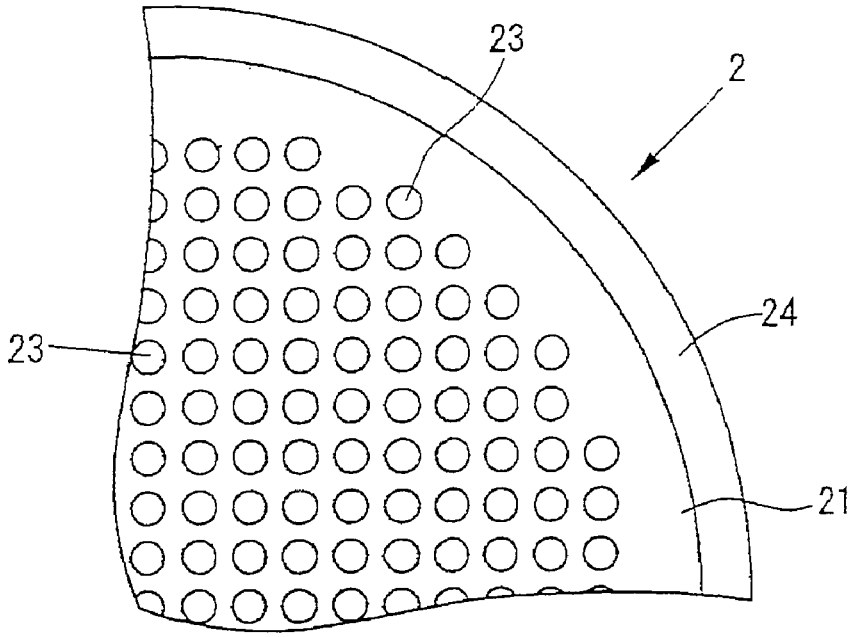
FIG. 23 is a bottom view showing a matrix of pillars formed in a quarter of the head body.
Figure 24:
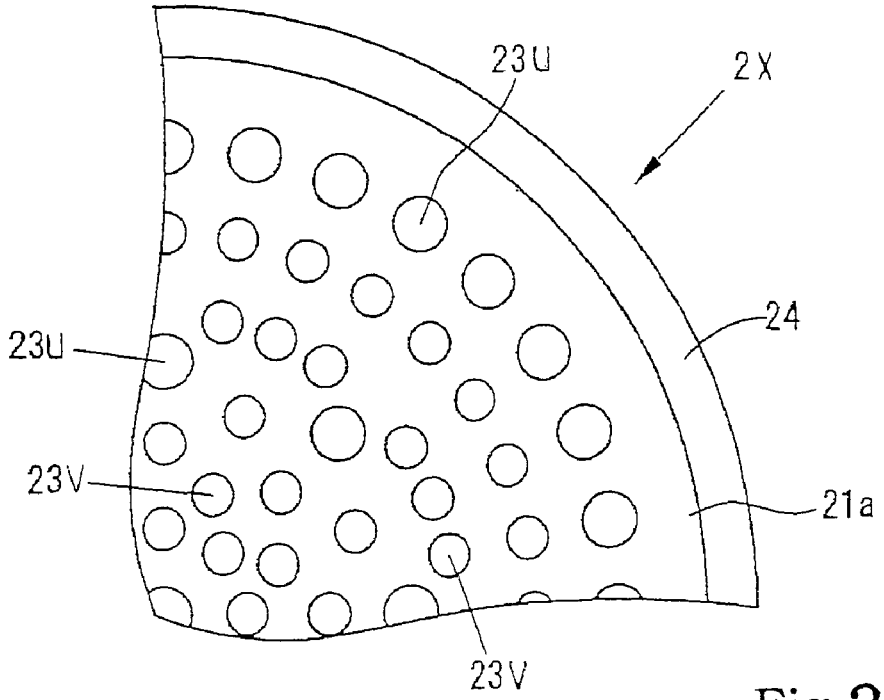
FIG. 24 is a bottom view showing another arrangement of pillars formed in a quarter of another head body.

The pillars 23, which are constant in density and uniform in size and shape, do not set any-limit on the scope of the present invention. A drum head may have pillars different in size and shape, and the density may be locally varied. For example, a drum head may have large-sized pillars under the central area of the solid portion and small-sized pillars under the peripheral area of the solid portion. Another drum head may have small-sized pillars among large-sized pillars. The pillars of a drum head may be arranged in rows and columns as shown in FIG. 23. Otherwise, the pillars 23*u*/23*v* of another drum head 21X may be concentrically arranged under the solid portion as shown in FIG. 24. The large-sized pillars 23*u* are concentrically arranged at intervals, and the small-sized pillars 23*v* are also concentrically arranged in the areas between the large-sized pillars 23*u*. The pillars may be spaced from the adjacent pillars at regular intervals. Otherwise, the pillars are spaced from the adjacent pillars at irregular intervals. The regularly arranged pillars are preferable from the viewpoint of constant muting characteristics. Thus, the designer has various options so as to optimize drum heads according to the present invention to target muting characteristics and target restitution characteristics.

The monolithic structure of solid portion 21' and accumulating portion 22 does not set any limit to the scope of the present invention. The solid portion and accumulating portion may be physically separated from one another. In this instance, the solid portion, accumulating portion and base plate are assembled into a drum head.

Figure 25:
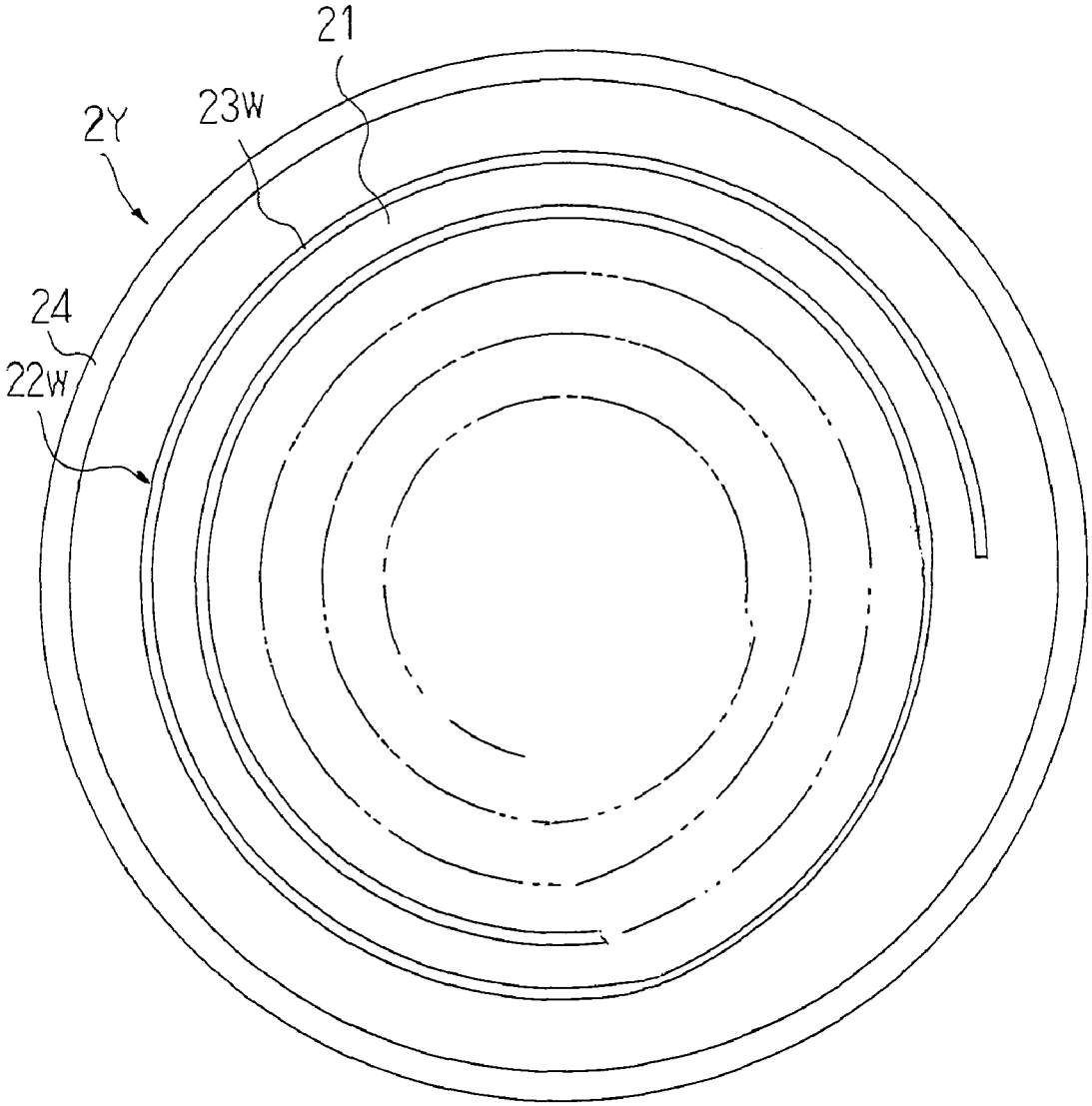
FIG. 25 is a bottom view showing another accumulating portion incorporated in yet another drum.

The pillars 23, 23B, 23C and 23D per se do not set any limit to the scope of the present invention. Any locally deformable structure is available for the drums according to the present invention. A drum head 2Y has the solid portion 21' and an accumulating portion 22*w*, and the accumulating portion 22*w* is implemented by a spiral wall 23*w* as shown in FIG. 25. Otherwise, plural ring-shaped walls may be concentrically arranged under the solid portion 21'. Deep notches may be formed in the spiral wall 23*w* and the ring-shaped walls.

The base plates 25/121C do not set any limit to the scope of the present invention. Plural plates may form in combination a base plate. One of the plural plates is a disc, and another plate is a ring. The disc is adhered to the pillars in a central zone of the array, and the ring is adhered to the pillars in the peripheral zone of the array. Thus, more than one plate is connected in series to the solid portion.

In the second embodiment, the array of pillars 23 may be merely held in contact with the base plate 25. In this instance, the supporting brackets 30 keep the base plate 25 held in contact with the pillars 23.

In the fourth embodiment, the supporter 30 may be secured to the inner surface of the shell 1C for softly pressing the base plate 125C to the solid portion 121. In this instance, the base plate 125C may be merely held in contact with the solid portion 121. The pillars 123 may be directly adhered to the base plate 125C.

In the fifth embodiment, the center hole 35*a* and air-vent 35*b* are formed in the protection sheet 35. However, another hole may be further formed in the protection sheet 35.

The head body 34 may be put on the drum head 20A. The head body 34 also prolongs the lifetime of the drum head 20A. In this instance, the head body 34 is reversed, and the pillars 39*a* upwardly project from the solid portion 21' on the array of pillars 123. The solid portion 21' is adhered or fusion bonded to the array of pillars 123. The cover sheet 129 may be adhered or fusion bonded to the array of pillars 39*a*.

The intervening plate 25' may have plural pieces. In case where the plural pieces are concentrically nested, a center disc is located in a central area of the array of pillars 39*a*, and a ring is provided under the peripheral area of the array of pillars 39*a*.

The intervening plate 25' and head body 34 may be used in the drum 20 or 20A. The pillars 123 are adhered or fusion bonded to the lower surface of the intervening plate 25', and the pillars 39*a* are adhered or fusion bonded to the upper surface of the intervening plate 25'. In this instance, the solid portion 38 offers a surface to be beaten with sticks to drummers. Otherwise, the solid portion 38 is adhered or fusion bonded to the upper surface of the intervening plate 25'. In this instance, the array of pillars 39*a* is beaten with the sticks. The cover sheet may be adhered to the array of pillars 39*a*.

The vibration sensors 40/50/60 may be directly adhered to the electronic drum by means of a piece of pressure sensitive adhesive sheet. Otherwise, a cushion layer may be inserted between the vibration sensor 40/50/60 and the electronic drum.

The piezoelectric converter does not set any limit to the technical scope of the present invention. A photo-coupler or a magnetic pick-up may be used in the vibration sensors 40/50/60.

The piezoelectric converter 40*a* may be offset from the center of the base plate 25. Plural pieces of vibration absorber may be adhered between the lower surface of the base plate 25 and the sensor boat 41.

The vibration sensor 40 may be adhered to the center area of the base plate 25 exposed to the center hole 35*a*. A sheet of vibration absorber may be inserted between the center area and the boat 41.

The base plate 25 in the electronic drum may be different in thickness between the central area and the remaining area. Drummers tend to beat the central area of the drum head 2–2G, 20–20B. If the base plate 25 is constant in thickness, the beats on the central portion strongly shake the base plate so that the first peak value becomes much higher than the first peak value at the beats on the peripheral portion. In order to equalize the first peak values, a base plate may have the central portion thicker than the peripheral portion.

The drum and cymbal do not set any limit to the technical scope of the present invention. Another sort of percussion instrument such as, for example, a marimba, a vibraphone, kettledrums or a gong may have the structure like one of the structures shown in FIGS. 1 to 13, and the vibration sensors may be provided for the percussion pad of the percussion instrument. Thus, the silent drums and silent cymbals are merely examples of the silent percussion instrument.

Terms used in claims are correlated with the components of the embodiments as follows. The flat surface 21*a* of the solid portion 21', the upper surface 129*a* of the cover layer 129, the upper surfaces of the pillars 123, the upper surface 38*a* of the head body 34 serve as a surface to be beaten by a drummer, and the accumulating portion 22, the arrays of pillars 123 and the accumulating portion 39 are corresponding to an accumulator. The base plates 25 and 125C serve as a base. The shells 1, 1A, 1B, 1C, 1D, 1E, 1F and 1G are corresponding to a supporting structure. The tension regulator 5, 5A, 5B, 5C, 5D, 5E, 5F and 5G serve as a coupling device. The electronic drum sound generating system is corresponding to a percussion sound generator.

The supporter 30 and protection sheet 35/36 serve as a supporter.

What is claimed is:

1. A percussion pad comprising a surface to be beaten by a player for producing an electric signal used in generation of percussion sound, the surface being smooth and extending without apertures, an accumulator made of resilient material and having an array of pillars, said pillars being connected in parallel to said surface so as to be locally deformed at each beat by said player for accumulating an elastic strain energy, the deformed pillars being vibratory while said elastic strain energy is being released, and a base made of a material smaller in resiliency than said accumulator, provided on the opposite side of said accumulator to said surface and held in contact with said accumulator regardless of each said beat for permitting said accumulator to be locally deformed.

2. The percussion pad as set forth in claim 1, further comprising a solid portion made of a resilient material having a large damping factor and having an obverse surface serving as said surface and a reverse surface connected to said array of pillars.

3. The percussion pad as set forth in claim 2, in which said array of pillars projects from said reverse surface of said solid portion toward said base.

4. The percussion pad as set forth in claim 3, in which said solid portion and said array of pillars are formed in a monolithic pad body.

5. The percussion pad as set forth in claim 4, in which said monolithic pad body is made of elastomer.

6. The percussion pad as set forth in claim 3, in which said pillars are shaped into a frustum, and are integral with said solid portion.

7. The percussion pad as set forth in claim 3, in which said array has large-sized pillars and small-sized pillars.

8. The percussion pad as set forth in claim 3, in which said array contains the pillars arranged at a high density and other pillars arranged at a low density.

9. The percussion pad as set forth in claim 3, further comprising a cushion layer made of said resilient material and having an obverse surface bonded to said accumulator and a reverse surface bonded to said base.

10. The percussion pad as set forth in claim 1, in which said accumulator is formed by an array of pillars projecting from a solid portion made of a resilient material, and surfaces at the tips of said pillars form in combination said surface to be beaten by said player.

11. The percussion pad as set forth in claim 10, said solid portion and said array of said pillars are formed in a monolithic pad body.

12. The percussion pad as set forth in claim 11, in which said monolithic pad body is made of elastomer.

13. The percussion pad as set forth in claim 10, further comprising a cover sheet made of a durable resilient material and having an obverse surface serving as said surface and a reverse surface bonded to said surfaces at said tips of said pillars.

14. The percussion pad as set forth in claim 1, further comprising a supporter for keeping said base held in contact with said accumulator.

15. The percussion pad as set forth in claim 14, in which said supporter is formed by a protection sheet covering a reverse surface of said base reverse to an obverse surface held in contact with said accumulator and secured to said accumulator.

16. The percussion pad as set forth in claim 14, in which said protection sheet is formed with an air-vent allowing the air to pass therethrough when said accumulator is deformed.

17. The percussion pad as set forth in claim 1, further comprising a head body made of a resilient material and having an obverse surface serving as said surface and an array of pillars for accumulating an elastic strain energy at each beat and connected in series to said accumulator.

18. The percussion pad as set forth in claim 17, in which said accumulator is formed by another array of pillars projecting from a solid portion to said base, and said array of pillars is held in contact with said solid portion.

19. The percussion pad as set forth in claim 18, further comprising another base smaller in resiliency than said array of pillars and provided between said array of pillars and said solid portion.

20. A silent percussion instrument comprising:

a percussion pad including a surface to be beaten by a player for producing an electric signal used in generation of percussion sound, the surface being smooth and extending without apertures, an accumulator made of resilient material and having an array of pillars connected in parallel to said surface so as to be locally deformed at each beat by said player for accumulating an elastic strain energy, the deformed pillars being vibratory while said elastic strain energy is being released, and a base made of a material smaller in resiliency than said accumulator, provided on the opposite side of said accumulator to said surface and held in contact with said accumulator regardless of said each beat for permitting said accumulator to be locally deformed;

a supporting structure for keeping said percussion pad in an attitude convenient to be beaten by said player; and a coupling device connected between said percussion pad and said supporting structure for preventing said percussion pad from separation from said supporting structure.

21. The silent percussion instrument as set forth in claim 20, in which said percussion pad further includes a solid portion made of a resilient material and connected in series to said array of pillars a rigid portion coupled to said supporting structure by means of said coupling device and a resilient portion provided between said solid portion and said rigid portion for permitting said percussion pad to repeatedly move in a direction in which said drummer exerts a force on said surface.

22. The silent percussion instrument as set forth in claim 20, further comprising a supporter for keeping said base held in contact with said accumulator.

23. The silent percussion instrument as set forth in claim 22, in which said supporter has plural brackets secured to said supporting structure at intervals and plural cushion blocks respectively secured to said plural brackets and held in contact with said base for preventing said base from separation from said accumulator.

24. The silent percussion instrument as set forth in claim 22, in which said supporter has a protection layer covering a reverse surface of said base and secured to a peripheral portion of said solid portion.

25. The silent percussion instrument as set forth in claim 20, in which said percussion pad and said supporting structure have a shape analogous to that of a drum head forming a part of an acoustic drum and another shape analogous to that of a shell forming another part of said acoustic drum.

26. The silent percussion instrument as set forth in claim 20, further comprising at least one vibration sensor monitoring said percussion pad to see whether or not said player gives said surface an impact and producing an electric signal representative of said impact when said at least one vibration sensor finds said player to give said impact.

27. The silent percussion instrument as set forth in claim 26, further comprising another vibration sensor monitoring said supporting structure to see whether or not said player gives an impact to said supporting structure and producing an electric signal representative of said impact when said another vibration sensor finds said player to give said impact.

28. A silent percussion instrument set comprising plural silent percussion instruments, at least one of said plural silent percussion instruments including a percussion pad having a surface to be beaten by a player for producing an electric signal used in generation of percussion sound, the surface being smooth and extending without apertures, an accumulator made of resilient material and having an array of pillars, said pillars being connected in parallel to said surface so as to be locally deformed at each beat by said player for accumulating an elastic strain energy, the deformed pillars being vibratory while said elastic strain energy is being released; and a base made of a material smaller in resiliency than said accumulator, provided on the opposite side of said accumulator to said surface and held in contact with said accumulator regardless of said each beat for permitting said array of pillars to be locally deformed, a supporting structure for keeping said percussion pad in an attitude convenient to be beaten by said player, and a coupling device connected between said percussion pad and said supporting structure for preventing said percussion pad from separation from said supporting structure.

29. The silent percussion instrument set as set forth in claim 28, in which said one of said plural silent percussion instruments further comprises at least one vibration sensor monitoring said percussion pad to see whether or not said player gives said surface an impact and producing an electric signal representative of said impact when said at least one vibration sensor finds said player to give said impact.

30. The silent percussion instrument set as set forth in claim 29, in which said one of said plural silent percussion instruments further comprises another vibration sensor monitoring said supporting structure to see whether or not said player gives an impact to said supporting structure and producing an electric signal representative of said impact when said another vibration sensor finds said player to give said impact.

31. The silent percussion instrument set as set forth in claim 28, in which the others of said plural silent percussion instruments have respective percussion pads, respective supporting structures and respective coupling devices respectively similar to said percussion pad, said supporting structure and said coupling device.

32. The silent percussion instrument as set forth in claim 31, in which each of said others of said plural silent percussion instruments includes at least one vibration sensor monitoring said percussion pad to see whether or not said player gives said surface an impact and producing an electric signal representative of said impact when said at least one vibration sensor finds said player to give said impact.

33. The silent percussion instrument set as set forth in claim 32, in which each of said others of said plural silent percussion instruments further includes another vibration sensor monitoring said supporting structure to see whether or not said player gives an impact to said supporting structure and producing an electric signal representative of said impact when said another vibration sensor finds said player to give said impact.

34. The silent percussion instrument set as set forth in claim 32, further comprising a percussion sound generating system connected to said at least one vibration sensor of said one of said plural silent percussion instruments and said at least one vibration sensor of said each of said others of said plural silent percussion instruments and selectively producing different sorts of percussion sound in response to said electric signals.

35. The silent percussion instrument set as set forth in claim 28, in which said one of said plural silent percussion instruments has an external appearance close to an acoustic drum.

36. The silent percussion instrument set as set forth in claim 28, in which said one of said plural silent percussion instruments has an external appearance close to an acoustic cymbal.

37. An electronic percussion system, comprising:

a silent percussion instrument including a percussion pad including a surface to be beaten by a player, the surface being smooth and extending without apertures, an accumulator made of resilient material and having an array of pillars, said pillars being connected in parallel to said surface so as to be locally deformed at each beat by said player for accumulating an elastic strain energy, the deformed pillars being vibratory while said elastic strain energy is being released and a base made of a material smaller in resiliency than said accumulator, provided on the opposite side of said accumulator to said surface and held in contact with said accumulator regardless of said each beat for permitting said accumulator to be locally deformed, a supporting structure for keeping said percussion pad in an attitude convenient to be beaten by said player, and a coupling device connected between said percussion pad and said supporting structure for preventing said percussion pad from separation from said supporting structure;

at least one vibration sensor monitoring said percussion pad to see whether or not said player beats said surface and producing an electric signal when said player gives each beat to said surface; and an electronic percussion sound generator connected to said at least one vibratory sensor, carrying out a data processing on pieces of data information on said electric signal for producing an audio signals and converting said audio signal to an electronic percussion sound.

38. The electronic percussion system as set forth in claim 37, in which said at least one vibration sensor monitors said percussion pad to see whether or not said player gives an impact thereto, and produces said electric signal representative of said impact.

39. The electronic percussion system as set forth in claim 38, further comprising another vibration sensor monitoring said supporting structure to see whether or not said player gives an impact thereto and producing another electric signal representative of said impact, and in which said another electric signal is supplied to said electronic percussion sound generator so as to be processed as similar to said electric signal.

40. The electronic percussion system as set forth in claim 38, in which said at least one vibration sensor monitors said percussion pad and said supporting structure to see whether or not said player gives an impact thereto, and produces said electric signal representative of said impact, and in which said electronic percussion sound generator selectively produces different sorts of electronic percussion sound depending upon the decision on said electric signal.

* * * * *